US011737507B1

(12) United States Patent
Chowdhury et al.

(10) Patent No.: US 11,737,507 B1
(45) Date of Patent: Aug. 29, 2023

(54) INTELLIGENT AUTOMATED FOOTWEAR

(71) Applicants: Azmal Chowdhury, Miami, FL (US); Borzooye Jafarizadeh, Miami, FL (US); Nezih Pala, Miami, FL (US); Chunlei Wang, Miami, FL (US)

(72) Inventors: Azmal Chowdhury, Miami, FL (US); Borzooye Jafarizadeh, Miami, FL (US); Nezih Pala, Miami, FL (US); Chunlei Wang, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 18/050,616

(22) Filed: Oct. 28, 2022

(51) Int. Cl.

| | |
|---|---|
| ***A43B 3/00*** | (2022.01) |
| ***A43B 3/38*** | (2022.01) |
| ***A43B 7/04*** | (2006.01) |
| ***A43B 3/46*** | (2022.01) |
| ***A43B 3/35*** | (2022.01) |
| ***A43B 3/42*** | (2022.01) |
| ***A43B 3/40*** | (2022.01) |
| ***A43B 3/48*** | (2022.01) |

(52) U.S. Cl.
CPC ..... *A43B 3/46* (2022.01); *A43B 3/35* (2022.01); *A43B 3/40* (2022.01); *A43B 3/42* (2022.01); *A43B 3/48* (2022.01)

(58) Field of Classification Search
CPC .... A43B 3/46; A43B 3/48; A43B 3/35; A43B 3/42; A43B 3/40
See application file for complete search history.

(56) References Cited

U.S. PATENT DOCUMENTS

| | | | | |
|---|---|---|---|---|
| 7,186,957 | B2 * | 3/2007 | Martin | A43B 7/005 62/3.3 |
| 9,109,583 | B2 * | 8/2015 | Krupenkin | F03G 5/06 |
| 9,259,047 | B2 * | 2/2016 | Krupenkin | H02N 1/08 |
| 10,264,846 | B2 * | 4/2019 | Krupenkin | A43B 13/189 |
| 10,398,189 | B2 * | 9/2019 | Amos | A61B 5/0002 |
| 10,973,276 | B2 * | 4/2021 | Akay | A43B 3/34 |
| 11,122,856 | B2 * | 9/2021 | Kong | A43B 3/34 |
| 11,284,667 | B2 * | 3/2022 | Chen | H02J 50/402 |
| 2006/0060185 | A1 * | 3/2006 | Dehn | A43B 7/02 122/26 |
| 2011/0153197 | A1 * | 6/2011 | Song | G01S 19/14 702/139 |
| 2012/0260522 | A1 * | 10/2012 | Shi | A43B 3/35 36/2.6 |

(Continued)

*Primary Examiner* — Jila M Mohandesi
(74) *Attorney, Agent, or Firm* — Saliwanchik, Lloyd & Eisenschenk

(57) ABSTRACT

Sensors, actuators, energy sources, and data processing for enabling artificial intelligent (AI) integrated automated features of intelligent electronic shoes are provided. The intelligent footwear can gather information from the shoe and send the data to a user interface for monitoring the physical activities of the wearer. A smart thermal actuation system can control the internal temperature of the shoe to offer a comfortable experience to the user. Intelligent footwear can also have systems for multipurpose sensing and actuation modules, which can use energy harvested by the user locomotion or by an energy source accompanied by artificial intelligence to gather and process information for ensuring an enhanced user experience.

20 Claims, 16 Drawing Sheets

(56) References Cited

U.S. PATENT DOCUMENTS

| | | | | |
|---|---|---|---|---|
| 2013/0247410 | A1* | 9/2013 | Tseng | A43B 3/35<br>36/2.6 |
| 2014/0130381 | A1* | 5/2014 | Jung | A43B 7/00<br>320/108 |
| 2018/0206586 | A1* | 7/2018 | Akay | A43B 3/34 |
| 2019/0159543 | A1* | 5/2019 | Sharpes | A43B 3/38 |
| 2019/0254380 | A1* | 8/2019 | Vamvas | A43B 3/38 |
| 2020/0214386 | A1* | 7/2020 | Folske | G01C 22/006 |
| 2022/0395229 | A1* | 12/2022 | Everett | A61B 5/743 |

* cited by examiner

INTELLIGENT AUTOMATED FOOTWEAR

GOVERNMENT SUPPORT

This invention was made with government support under 164845 awarded by the National Science Foundation. The government has certain rights in the invention.

BACKGROUND

In recent years, the concept of smart technology for wearable apparel applications has seen great advancements and made our lives easier. Such smart technologies use various sensors to gather data and transmit the same to a user interface and can provide much data for our daily activities. As the technology further advances, these technologies have been applied beyond wearable electronics and also used with textiles, smart footwear, and smart clothing.

Wearing shoes provides protection while walking or running, and with the usage of smart sensing technologies, the functionality increases to another level. In related art, smart shoes with multifunctional activities such as tracking function, telecommunication based on GPS, using pressure sensors for gait analysis, temperature sensors, and many more have been developed. For example, there have been several accessories such as GPS or location tracker applied to footwear to ensure the safety of children or elderly users suffering from memory issues. However, such related art smart shoes can only sense and transmit data to a user interface without having any functional actuation system that could aid the wearer with a more comfortable lifestyle through incorporation with the smart sensing system.

Wearable flexible piezoresistive pressure sensors hold wide-ranging potential in human health monitoring, electronic skin, robotic limbs and other human-machine interfaces. Out of the most successful recent efforts for arterial pulse monitoring are sensors with micro-patterned conductive elastomers. However, low current output signal (typically in the range of nanoamperes) necessitates the application of bulky and expensive measurement equipment for useful signal acquisition, which inhibits the wearability, functionality, and benefit of such related art systems.

Over the past decade, research in the field of ultra-sensitive pressure sensors have seen an upsurge. This is due to their potential applications in wearable and flexible electronic sensors for motion detection, biomedical monitoring, human machine interaction, and also artificial intelligence assisted tactile sensing. Depending on the eventual application, the pressure ranges in which the sensor operates are categorized into four regimes: ultra-low pressure (<1 Pascal (Pa)), subtle-pressure (1 Pa-1 kiloPascal (kPa)), low-pressure (1 kPa-10 kPa), and lastly medium-pressure (10 kPa-100 kPa). Of all these categories, significant attention has been paid to the subtle-pressure regime because of its importance in development of electronic skin (e-skin), touch screen devices, and non-invasive detection of weak human physiological signals such as blood pressure and pulse wave detection on the wrist. Different successful schemes such as piezoresistive, capacitive, piezoelectric, and triboelectric have been reported. Specifically, piezoresistive sensors have drawn much attention because of their fast response, broad detection range, simple structure, and simplicity of signal measuring system.

In recent years, various structures and sensing materials have been proposed to achieve highly sensitive piezoresistive pressure sensors. One of the popular sensor platforms is based on elastomers, such as conductive polymeric films or composites with distinct structural schemes such as micro-pyramids, micro-domes, micro-pillars, and micro-cones. However, the lack of parametric understanding and the lack of design rules for fabrication of these microstructures inhibits achievement of the highest available sensitivity in lowest required footprint area. Although there have been successful piezoresistive pressure sensors, achieving the high levels of sensitivity necessary to detect human pulse wave, sound wave, or subtle pressure changes caused by object manipulation are still challenging. In almost all cases, output of the sensors when measuring weak physiological signals, such as pulse from the wrist are in range of nanoamps (nA).

BRIEF SUMMARY

Embodiments of the present invention provide intelligent automated footwear with controllable features that comes with a multiplicity of features including but not limited to smart sensing using sensors, conditioning the internal environment of the shoe (e.g., temperature and humidity) using actuators, and control systems for executing automated features. Embodiments provide a smart shoe that utilizes an ergonomic design to distribute the sensing elements across the shoe and the actuators for controlling the internal atmosphere which are sensed and controlled by a built-in micro-controller. In certain embodiments an alert system is also embedded in the shoe that can alert the user (e.g., by creating a vibration signal). The smart shoe can wirelessly communicate with an external device using an app. Through this cell phone app, the user is able to access the health condition statistics and also set the temperature for the internal environment of the shoe. Embodiments of the present invention provide an energy harvesting mechanism to recharge the primary energy source of the intelligent device by using the locomotion energy of the user.

Embodiments of the present invention relate generally to intelligent electronic footwear. Particularly, embodiments provide sensors, actuators, energy sources, and data processing for enabling artificial intelligence (AI) integrated automated features of intelligent electronic shoes.

In an embodiment, an intelligent automated footwear system can comprise: a shoe having embedded therein a plurality of sensors and actuators, the plurality of sensor and actuators comprising: a plurality of pressure sensors, each respective pressure sensor of the plurality of pressure sensors configured to measure a respective contact pressure in a designated region of the shoe; an environmental sensor configured to measure an internal environmental parameter of the shoe; a location or orientation sensor configured to measure a geospatial, positional, kinematic, dynamic, or orientation-related parameter of the shoe; and a thermal actuator system configured to control an internal environmental parameter of the shoe. The intelligent automated footwear system can further comprise a thermal management system (e.g., embedded in the shoe) connected to the thermal actuator system; an alert system (e.g., embedded in the shoe) configured to provide a feedback, alert, or communication signal through the shoe; a processor (e.g., embedded in the shoe); an in-built power supply (e.g., embedded in the shoe) configured to supply power as needed to operate the plurality of pressure sensors, the environmental sensor, the location or orientation sensor, the thermal actuator system, the thermal management system, the alert system, and the processor; an energy harvester (e.g., embedded in the shoe) configured to recharge the in-built power supply by harvesting energy from locomotion of a user of the shoe; and a machine-readable medium (e.g., embedded in the shoe) in operable communication with the processor and having instructions stored thereon that, when executed by the processor, perform the following steps: receiving, by the processor, a setpoint for the internal environmental parameter of the shoe; receiving, by the processor, a measurement of the internal environmental parameter of the shoe; and sending, by the processor, a control signal to the thermal actuator system, to drive the measurement of the internal environmental parameter of the shoe to within a tolerance of the setpoint for the internal environmental parameter of the shoe. The system can further comprise an external smart device operable by the user of the shoe to input the setpoint for the internal environmental parameter of the shoe, for transmission to the processor. The instructions, when executed by the processor, can further perform the following step: transmitting, by the processor, to the external smart device, the measurement of the internal environmental parameter of the shoe, for display to the user of the shoe on the external smart device. Each respective pressure sensor of the plurality of pressure sensors can be, for example, a piezoresistive pressure sensor. The environmental sensor can comprise, for example, a temperature sensor, a humidity sensor, and/or a moisture sensor. The location or orientation sensor can comprise, for example, an acceleration sensor, a gyro, an inertial measurement unit (IMU), and/or a global positioning system (GPS) sensor. The thermal actuator system can comprise, for example, a Peltier effect device, a Seebeck effect device, and/or a Joule/Thomson effect device. The thermal management system can comprise a rigid water reservoir, a compressible water reservoir, a flexible channeling, a check valve, and/or a heat sink. The alert system can be further configured to alert the user of the shoe by creating a vibration signal. The in-built power supply can comprise a rechargeable battery, a supercapacitor, a charging circuit, and/or a capacitor. The energy harvester can comprise, for example, a piezoelectric or triboelectric device (a piezoelectric device, a triboelectric device, or a device that can function as one or the other). Each respective pressure sensor of the plurality of pressure sensors can comprise a micropyramid surface deformed against a counter electrode, configured to measure the respective contact pressure. Each respective micropyramid surface on each respective pressure sensor of the plurality of pressure sensors can be patterned with a number density of 3 per millimeter ($mm^{-1}$), a feature size of 100 micrometers (μm), and a pyramidal angle (α) within a range of $50° < \alpha < 60°$. Each respective pressure sensor of the plurality of pressure sensors can comprise an elastomer layer, which can have a conductivity of equal to or greater than 10 Siemens per meter (S/m). The shoe can comprise an insole and an outsole that together encapsulate each respective pressure sensor of the plurality of pressure sensors, the environmental sensor, the location or orientation sensor, the alert system, the processor, the in-built power supply, the energy harvester, and/or at least a portion of the thermal management system. One or more (or all) of the piezoresistive pressure sensors can also be a capacitive/supercapacitive (i.e., capacitive and/or supercapacitive) pressure sensor configured to acquire a pulsewave form of the heart (of the user of the shoe) beating out from the foot area. Alternatively, the intelligent automated footwear system can comprise additional piezoresistive pressure sensors (in addition to those discussed above) that are capacitive/supercapacitive pressure sensors configured to acquire a pulsewave form of the heart (of the user of the shoe) beating out from the foot area.

In another embodiment, a method for controlling an intelligent automated footwear system can comprise: generating power from an energy harvester embedded within a shoe, the power being generated by locomotion of a user of the shoe; storing the power in an in-built power supply embedded within the shoe; powering a processor embedded within the shoe with the power, drawn from the in-built power supply embedded within the shoe; receiving, by the processor embedded within the shoe, a setpoint for an internal environmental parameter of the shoe, the setpoint received from an external smart device outside the shoe via a wireless connection; and receiving, by the processor embedded within the shoe, a measurement of the internal environmental parameter of the shoe, the measurement received from an environmental sensor embedded within the shoe. The method can further comprise: determining, by the processor embedded within the shoe, if the setpoint for the internal environmental parameter of the shoe and the measurement of the internal environmental parameter of the shoe are equal to within a predetermined tolerance; initiating, by the processor embedded within the shoe, if the setpoint for the internal environmental parameter of the shoe and the measurement of the internal environmental parameter of the shoe are not equal to within the predetermined tolerance, a heating or cooling cycle operable on a thermal actuator connected to a thermal management system, the thermal management system at least partially embedded within the shoe; and reporting to the external smart device outside the shoe via the wireless connection, by the processor embedded within the shoe, the measurement of the internal environmental parameter of the shoe and an indication of a status of the heating or cooling cycle. The method can further comprise: if the setpoint for the internal environmental parameter of the shoe and the measurement of the internal environmental parameter of the shoe are not equal to within the predetermined tolerance, initiating, by the processor embedded within the shoe, an alert event operable on an alert system embedded within the shoe (and if the setpoint for the internal environmental parameter of the shoe and the measurement of the internal environmental parameter of the shoe are within the predetermined tolerance, taking no action with respect to the alert event). The intelligent automated footwear system can comprise any of the features discussed herein.

In light of the advanced sensing technology, embodiments provide a feedback system that can collect the data from the smart shoes and generate the necessary response to offer an improved and more comfortable experience to the user. In related art, the term smart shoes has been applied to shoes having various sensing modules for sensing and transmitting data. Embodiments of the present invention can improve the overall wearer comfort and safety by providing a system that can not only sense from the shoes but also can activate actuator modules to advantageously manipulate, control, and improve the operating environment within, on, and around the shoes.

BRIEF DESCRIPTION OF DRAWINGS

FIG. 12*a* shows change in relative current as a function of normal pressure. FIG. 12*b* shows passing current as a function of normal applied pressure. FIG. 12*c* shows plot of area of contact between the two layers of the sensor as a function of decrease in layer spacing distance. FIG. 12*d* shows schematic of a pyramid and cone that undergoes compression and dependence of contact area on decrease in inter-layer spacing distance.

DETAILED DESCRIPTION

Figures 1A, 1B:
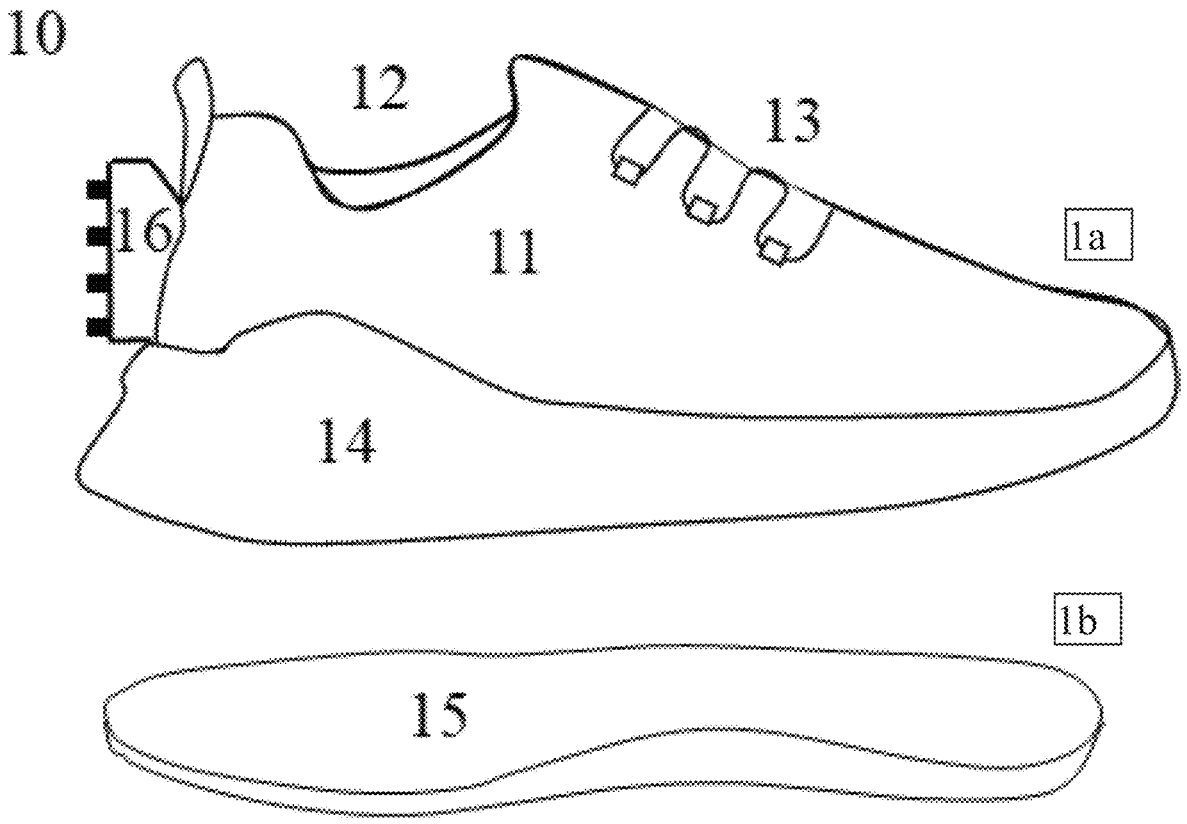
FIGS. 1*a* and 1*b* illustrate a side view of the appearance of an intelligent shoe (FIG. 1*a*) and sole (FIG. 1*b*) with select outer and inner parts, according to an embodiment of the present invention.

Embodiments of the present invention provide intelligent footwear having devices, systems, and methods for multi-purpose sensing and actuation modules that can use energy (e.g., energy harvested by user locomotion or energy provided by an energy source) accompanied by artificial intelligence to gather and process information for providing an enhanced user experience. Various non-limiting embodiments of smart or intelligent shoes or footwear are shown in the drawings which are used for exemplifying the embodiments, and may not fully represent the actual scale, proportions, or relationships of or between elements of additional embodiments in application to real shoes. Hereinafter, exemplary embodiments with reference to the accompanying drawings are described in detail. Throughout this specification, the terms smart shoe, intelligent shoe, smart footwear, and intelligent footwear can be used interchangeably except where otherwise noted.

FIGS. 1*a* and 1*b* show a representative embodiment of a smart shoe 10. With reference to FIGS. 1*a* and 1*b*, the upper portion of the shoe 11 covers the foot from the outside. The upper can provide the user with a comfortable wearability and can advantageously be durable, breathable to air, flexible, comfortable, and wear resistant. The shoe can be accessed using the opening 12. For ease of access, shoelace 13 can be used to tighten or loosen the shoe according to the user's comfort. The bottom part of the shoe includes the outsole 14 structure that separates the foot from the ground. The sole is connected to the upper part 11 of the shoe and provides cushioning, grip, stability and comfort. The sole structure of the shoe in general consists of an insole 15 and outsole 14 where the purpose of the insole 15 is to provide comfort, and the outsole 14 provides the cushioning, grip and stability of the shoe. In some embodiments, insole 15 can be removed from the shoe. For clarity, insole 15 is shown removed and outside of the shoe in FIGS. 1*a*-1*b*. In certain embodiments, the shoe employs a first insole and a second insole for additional comfort, ease of manufacturing, or layered functionality. In certain embodiments, the shoe employs a thermal actuator module 16 that can be used to control the internal temperature of the intelligent shoe.

FIGS. 2*a*-2*d* show schematic diagrams and overall configurations of an embodiment of an intelligent shoe. Referring to FIGS. 2*a*-2*d*, the intelligent shoe 10 can include multiple pressure sensors (e.g., as shown in regions 17-25) distributed in, on, around, covered by, or encapsulated by the insole 15 of the shoe, each respective pressure sensor configured and adapted for measuring a respective contact force in a designated region of the shoe. In certain embodiments the contact forces are correlated with the user standing on the shoe and can be used to support one or more calculations or analyses including determining the weight of the user, performing gait analysis, monitoring physical activities, conducting a posture analysis, and deriving or calculating other useful values or metrics. One or both of the intelligent shoes in a pair of shoes can include at least one (or more) temperature sensor(s) 26 for measuring the temperature inside, on, or around the shoe, humidity sensor 27 for measuring the humidity inside, on, or around the shoe, moisture sensor 28 for measuring the moisture content inside, on, or around the shoe, a global positioning system (GPS) sensor 29 to track the location and monitoring the movement of the user generally or the shoe specifically, and an acceleration sensor, gyro, or inertial measurement unit (IMU) 30 to sense the movement of the intelligent shoe. The sensors can be equipped with the shoe by placing them in different places that favor improved sensing performance from each sensor, or from a group of sensors. In certain embodiments, the same types of sensors can be used at different locations to provide a better sensing performance.

In certain embodiments, the intelligent shoe uses a thermal actuator module 16 for controlling the temperature inside the shoe. The thermal actuator module 16 comprises thermal actuator 31, and a thermal management system comprising an advantageous organization of rigid water reservoir 32, compressible water reservoir 33, flexible (e.g., nylon) channeling 34, check valve 35, and heat sink (e.g., acting as a thermal energy exchanger) 36. In certain embodiments an alert system 37 is also disposed inside the shoe for alerting the user in certain circumstances. Some or all of these components are connected to a central processing unit (CPU) 38, which is powered by a rechargeable battery, supercapacitor, charging circuit, or capacitor provided by in-built power supply 39. The battery can be recharged externally as well as by an energy harvester using the locomotion of the user.

The pressure sensors in regions 17-25 are advantageously employed in certain embodiments of the present invention. In one embodiment of the present invention, an array of pressure sensors in regions 17-25 are distributed on the insole 15 of the intelligent shoe. The pressure sensor array in regions 17-25 detects the total and distributed weight of the user and has the capability to map the pressure according to various activities of the user. In other embodiments, the pressure sensor (or various stress, strain, tension, or compression sensors) can be disposed in the outsole 14, insole 15, upper 11, shoelace 13, and other parts of the shoe for enhanced analysis of the user. In certain embodiments, one or more than one pressure sensor can be provided to sense the pressure in one or more regions.

The temperature sensor 26 can be disposed at different parts of the intelligent shoe including but not limited to the inside of the upper 11, outside of the outsole 14, embedding inside the insole 15, and other locations as known in the art or as may be later developed. The temperature sensor 26 can map the temperature inside the shoe to actuate the thermal actuator module 16 to control the temperature inside the shoe according to the user preference. Embodiments of the temperature sensor disposed at the outside of the intelligent shoe can measure the ambient, internal, surface, or other temperature and take corrective action to control the temperature inside the shoe if necessary, according to dynamic or predetermined criteria.

The humidity sensor 27 and moisture sensor 28 are placed inside the shoe for detecting the humidity and moisture content inside the shoe. The outputs from these sensors can let the user monitor the actual values for the interior of the shoe. When combined with the output values from the temperature sensor this can lead to activation of the heating mechanism simultaneously with the always-active drying mechanism to better achieve a desired drying action.

Looking further at FIGS. 2*a*-2*d*, in certain embodiments, at least one sensor for each type can be disposed inside the shoe to optimize the reading and corrective action of the intelligent shoe.

In certain embodiments, the intelligent shoe uses at least one GPS sensor 29 in both shoes of a pair of shoes for location data, monitoring the movements of the user, and other advantageous measurements. In one embodiment, the GPS sensor can communicate with the external smart device 55 or other user device for path finding which will be discussed further with reference to FIGS. 8, 9, and 10.

In certain embodiments an acceleration sensor or IMU 30 is disposed in one or both shoes to sense the movement of the user. The acceleration sensor senses the acceleration of the user and can be beneficial for monitoring physical activities.

The thermal actuation module 16 is provided in certain embodiments of the present invention. The thermal actuation module 16 can comprise, consist of, or consist essentially of a thermal actuator 31, two water reservoirs 32 and 33 for circulating the heat exchanger fluid (in both heating and cooling effects), a flexible channeling system 34 for fluid circulation and a heat sink 36 for exchanging an amount of heat buildup with the atmosphere or surrounding environment. The thermal actuation utilizes an electro-thermal process which can be achieved by providing electric power to a junction of two dissimilar joints that works on the basis of Peltier effect. The details of the thermal actuation are discussed with reference to FIGS. 2*a*-2*d* and FIG. 4.

In certain embodiments, an alert system 37 is disposed inside both of the shoes for alerting the user about different situations including but not limited to navigation guidelines, sending driving cautions if the speed limit is exceeded during driving, and other advantageous notifications. The alert system can be disposed inside the shoe in different places such as the outsole 14, insole 15, or the upper 11 of the shoe.

In certain embodiments, some or all of the sensors and related components are connected to the CPU 38 which can be a low powered microcontroller that receives certain data from the sensors and optionally communicates with the external device 55 for taking actions such as activating the thermal actuator module 16. The microcontroller can communicate with the external smart device or devices 55 using wireless communication such as BLUETOOTH, radio frequency (RF) communication, near field communication (NFC), WiFi communication, and other communication methods as known in the art or as may be later developed.

In certain embodiments, the intelligent shoe gets the necessary power for operating all the components using a power source such as rechargeable lithium battery, supercapacitor, or the combination of battery and supercapacitor as shown by in-built power supply 39 in FIGS. 2*a*-2*d*. The power source for the intelligent shoe can be disposed of in the outsole 14 of the shoe where it is protected due to the rigidity of the outsole 14. The battery can be recharged wirelessly or using a charging cable or other method of energy transfer. In certain embodiments, the intelligent shoe has the capability to recharge the battery using energy harvesting as shown in FIGS. 3*a*-3*d* and FIG. 7 from the locomotion of the user. The details of the energy harvesting are discussed with reference to FIG. 7.

In certain embodiments, the intelligent shoe can be paired with the external device 55 which can be but is not limited to a smartphone, a smart watch, tablet, and other devices as known in the art or as may be later developed. In certain embodiments, the user device 55 interacts with the intelligent shoe by collecting the sensor information and sending the command to the central processing unit 38 to activate the actuation systems if necessary. The user can change their preferences in the smart device 55 and get visual feedback shown in the user device 55 from the intelligent shoe.

Referring to FIGS. 2*a*-2*d*, the insole 15 shows the distribution of the pressure sensors for collecting the pressure sensing data according to an embodiment of the present invention. The pressure sensors can detect both static and dynamic foot pressure for the activities such as but not limited to monitoring the weight of the user for maintaining a healthy lifestyle, mapping the foot pressure of the user to check for any abnormalities in strides, for gait analysis, and other analysis as known in the art or as may be later developed. In one embodiment of the present invention, the pressure sensors are disposed across the insole 15 of the shoes. For deploying the pressure sensors, the insole 15 can be divided into different regions. In some embodiments, the insole 15 can have regions where foot pressure is high as shown in regions 17 and 20, low pressure regions indicated by regions 18 and 19, and the pressure regions corresponding to the individual toes of the user as indicated by regions 21-25. In certain embodiments, the pressure sensitivity requirements at different regions can different. The high pressure regions such as region 17 and region 20 do not require very fine pressure sensitivity since adequate data can be obtained at lower sensitivity in higher pressure regions. However, the low pressure regions require fine pressure sensitivity of the sensors to accurately detect and map the foot pressure during different activities.

FIGS. 3*a*-3*d* show more detailed views of the pressure sensors. Referring to the FIGS. 2*a*-2*d*, a high pressure region (e.g., region 17 as defined in FIGS. 2*a*-2*d*) is used here to explain the pressure sensing mechanism for the present invention. For mapping the foot pressure, any region can be divided into an array of pressure sensors as illustrated in FIGS. 3*a*-3*d*. The variation in pressure can provide important information about gait analysis, posture analysis, weight management, healthcare, information about certain workouts, ensuring proper workouts, counting steps, calculating stride lengths by combining pressure sensor data and location data, and many more advantageous measurements. In one embodiment, the pressure sensor array can be used for day to day weight tracking and weight management as a part of the fitness program that can run in the smart device 55. The day to day weight can be updated in the specific fitness app that can reduce the dependency on less accurate, less reliable, less available, or less convenient measurement devices such as washroom scales. The user device 55 can run an application that has several training programs for effective training of the user and monitor if there is any abnormality during training. In some embodiments, for a specific training such as performing squats, the foot pressure changes from heel to toe during the full range of motion of the user. However, during the proper exercise, the feet should always be in contact with the surface, and for beginners it can be challenging to have a proper balance while doing this exercise. The fitness app can monitor the pressure mapping and can effectively train the user if during the exercise, the pressure mapping conforms to certain standards. In certain embodiments, such interaction and training can be further benefited from application of artificial intelligence to track and monitor the physical activity and training purpose. The artificial intelligence (AI) can be used to track and monitor the performance of the user under the same conditions and give one or more ratings (e.g., indicating if the exercise is getting better for the user.)

Additional applications of predictive analytics can be made using the pressure mapping. In certain embodiments by analyzing the pressure mapping in both shoes, a user can be advantageously advised if there is any imbalance while walking that can come from several issues. For example, if the pressure mapping in both shoes is not almost the same, or differs by a known amount or quality, the user can suffer from some issues in his/her backbone that can worsen with time. By always communicating with the data, the user can effectively improve their posture.

In certain embodiments, the smart shoe can alert the user using the alert system 37 if the pressure sensors (or other sensors) indicate he/she has been sedentary for a long period of time and remind them to take a walk or do some physical activity. This is more reliable than relying on smart devices since the user seldom takes off shoes which is not the case if with the smart devices.

Since the pressure sensor arrays work both in the static and dynamic conditions, they can provide accurate weight data and be useful for accurate measurements of calories while doing any physical activity both indoors and outdoors, whether a bodyweight exercise or exercise with equipment.

Again referring to FIGS. 2*a*-2*d*, in certain embodiments the pressure sensor arrays can be distributed in different regions of the insole. In one embodiment, the respective pressure sensors used at different locations can be provided with different sensitivity even if using the same type of sensor. For example, pressure sensors disposed in region 17 do not require fine pressure sensitivity since the heel exerts high pressure on region 17. The same is also true for region 20. However, regions 18, 19, and 21-25 can be low pressure regions and the sensors deployed at those locations can require fine pressure sensitivity.

Figures 3A, 3B, 3C, 3D:
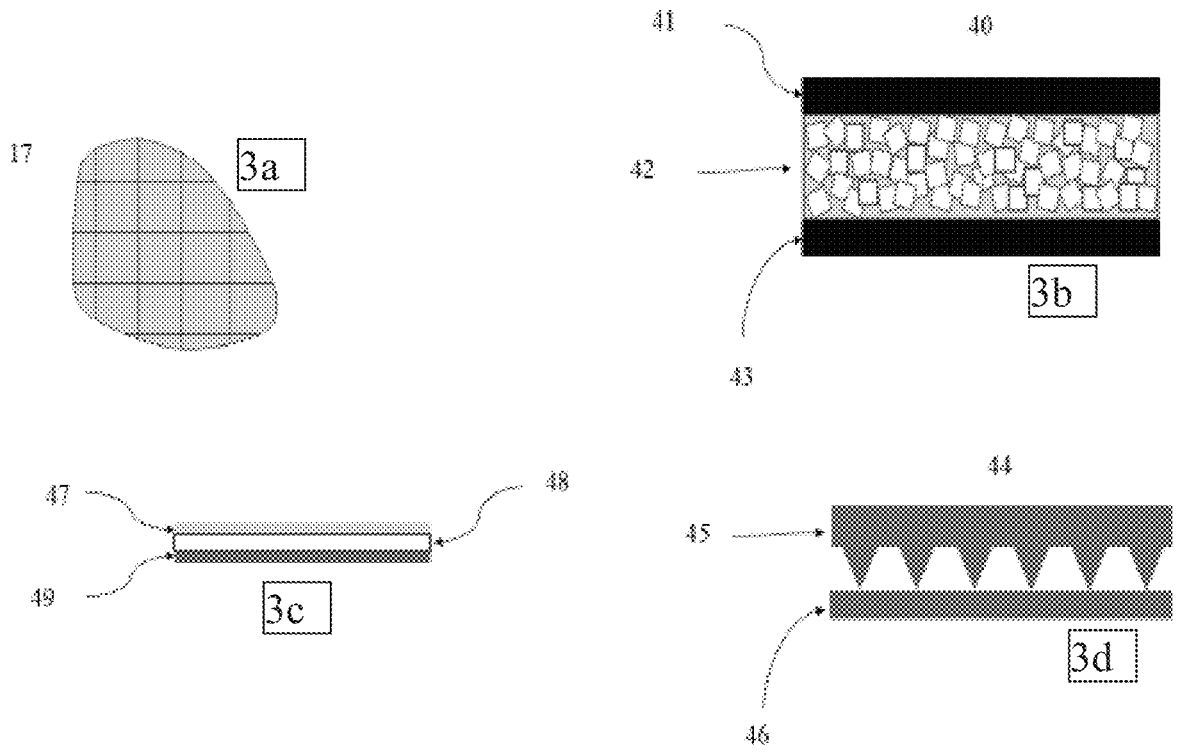
FIGS. 3*a*-3*d* illustrate several implementations of a pressure sensing mechanism for a smart shoe, according to embodiments of the present invention.
Figure 4:
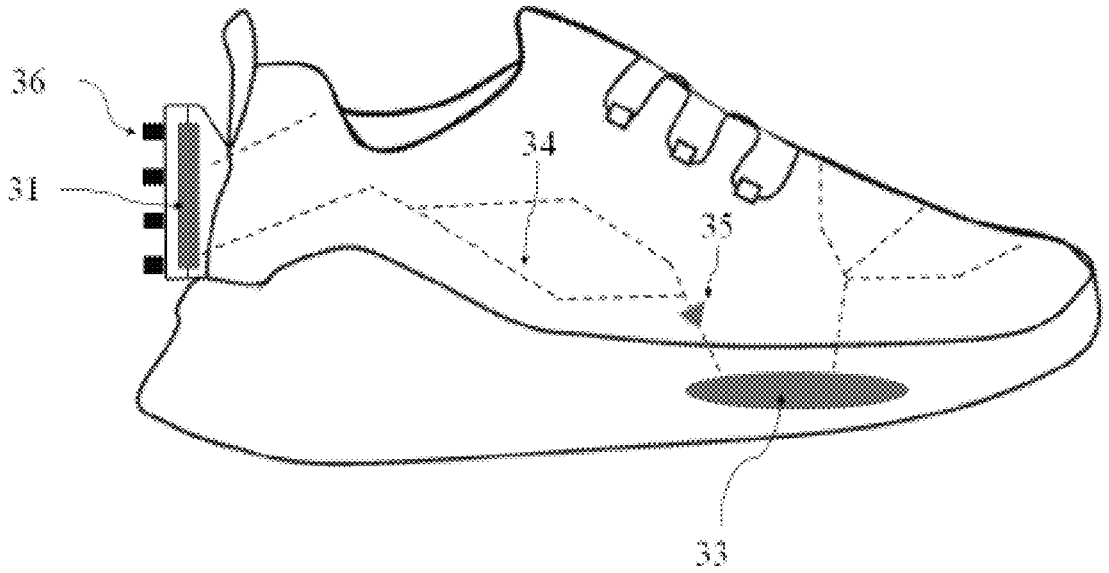
FIG. 4 schematically illustrates several components of heating/cooling mechanisms of a smart shoe according to an embodiment of the present invention.

Referring to FIG. 3*b*, one embodiment of the present invention can use a capacitive pressure sensor 40. The pressure sensor uses a porous dielectric layer 42 sandwiched between two flexible conductive electrodes 41 and 43. As the dielectric material, porous polydimethylsiloxane (PDMS) can be a very good choice for such applications because PDMS is flexible, soft, will provide cushioning effect, breathable, biocompatible, and cheap to fabricate. Also, the performance of capacitive pressure sensors having porous PDMS can be tuned by using different filler materials to increase the pressure sensitivity. In certain embodiments, capacitive pressure sensors with a porous dielectric layer have wide pressure sensing range prerequisite for foot pressure measurement. As the flexible electrode material there is a wide range of choice such as using conductive polymer, indium tin oxide (ITO)/polyethylene terephthalate (PET) (ITO/PET), conductive textile having breathability, and other materials as known in the art or as may be later developed.

In another embodiment, the present invention can use a piezoresistive pressure sensor 44. A piezoresistive pressure sensor detects the pressure as the resistance changes between two substrates. To bring a controlled change in resistance between two substrates, different engineering approaches can be undertaken such as creating micropatterns on one or both substrates, using porous conductive polymer with two electrodes, and other designs as known in the art or as may be later developed. In certain embodiments a highly pressure sensitive piezoresistive sensor can be realized by creating a micropyramid structure on one surface 45 of the piezoresistive pressure sensor where the micropyramid surface 45 is deformed against a counter electrode 46 and a controlled change in resistance can be achieved. The pressure range for piezoresistive pressure sensors can also be tuned by following different approaches. In some embodiments, region 17 and 20 can use piezoresistive pressure sensors with porous microstructures to achieve a wide pressure range. However, regions 18, 19, and 21-25 can benefit from highly sensitive piezoresistive pressure sensors 44 (e.g., sensors having surface microstructures.)

In another embodiment, the present invention can use a combination of both capacitive 40 and piezoresistive 44 pressure sensors to benefit from both. The sensor arrangements can use numerous permutations of capacitive and piezoresistive sensing until best optimization is achieved.

Figure 15:
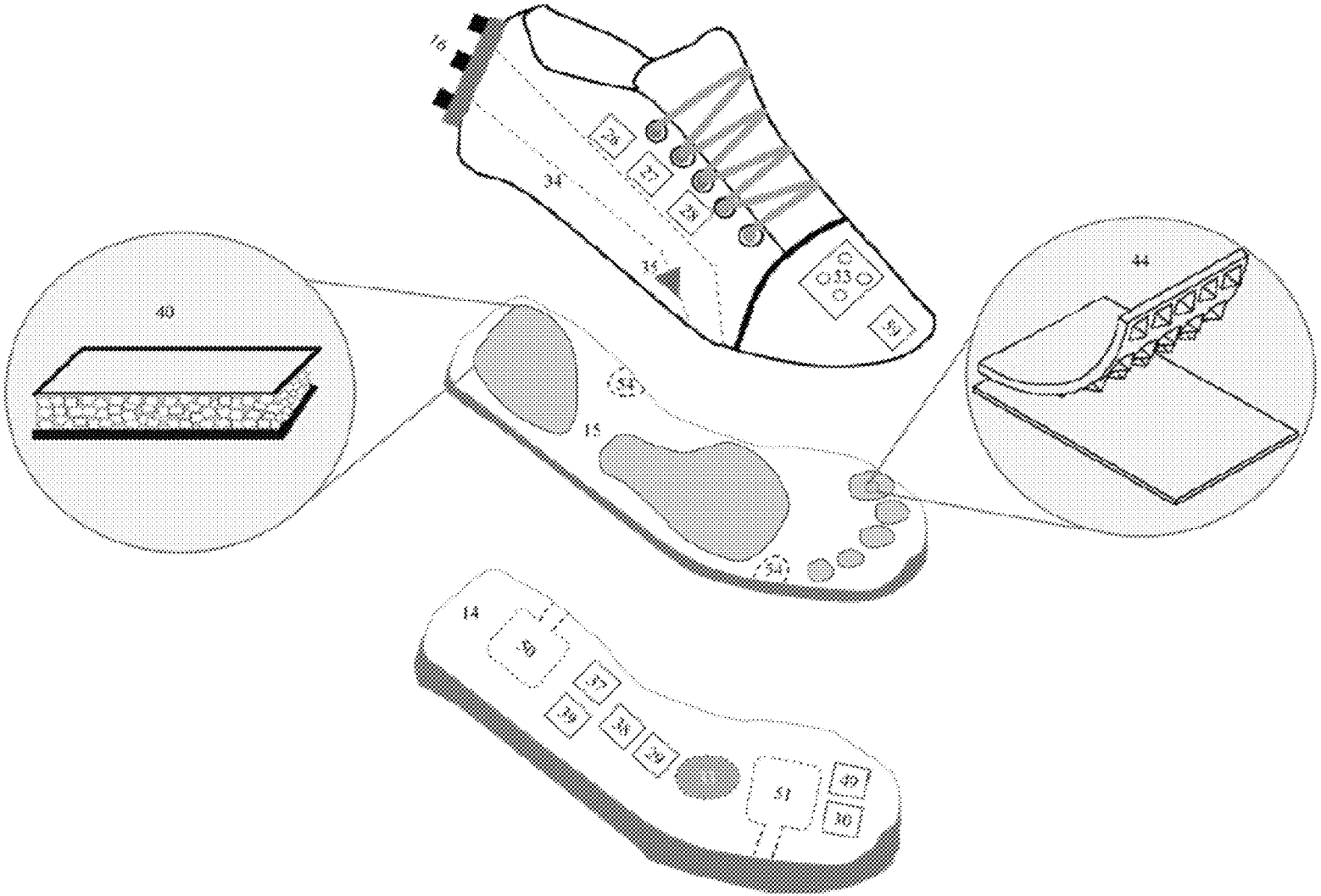
FIG. 15 illustrates a schematic design of an intelligent automated footwear system, according to an embodiment of the subject invention, including an insole and an outsole.

Referring to FIGS. 3*a*-3*d*, the pressure sensors can be arranged in the outsole 14 where a protective layer (e.g., insole 15) protects the pressure sensor 48 from getting direct contact with the foot. A protective layer can also advantageously protect the wiring of the pressure sensor that is connected to the central processing unit 38. FIG. 15 shows a schematic view that includes the insole 15 and the outsole 14 that together encapsulate each respective pressure sensor of the plurality of pressure sensors, the environmental sensor 27,28, the location or orientation sensor 29, the alert system 37, and the processor 38. Each respective pressure sensor of the plurality of pressure sensors can comprise a micropyramid surface deformed against a counter electrode, configured to measure the respective contact pressure. FIG. 15 also shows the in-built power supply 39, the energy harvester 49, and portions of the thermal management system (e.g., compressible water reservoir 33, flexible channeling 34, and check valve 35).

Referring to FIGS. 2*a*-2*d*, in certain embodiments the intelligent shoe disposes at least one temperature sensor 26 inside the shoe. The temperature sensor detects the temperature inside the shoe and sends the data to the external device 55. The external device 55 communicates with the central processing unit 38 to take necessary action on the thermal actuator 31. In one embodiment, if the internal temperature of the shoe detected by the temperature sensor 26 is higher than the setpoint set by the user in the smart device 55, the application sends a command to the CPU 38 to activate the thermal actuator 31 to cool it down. In another embodiment, if the temperature is lower than the setpoint, the application sends the command through the CPU 38 to take necessary action to heat the shoe. The temperature sensor can be deployed at some other locations such as outside the outsole 14 to detect the outside temperature. The data from the outside can prompt corrective action for maintaining a comfortable temperature inside the shoe. The user can set the temperature setpoint using the user device 55.

FIGS. 2*a*-2*d* and FIG. 4 schematically show an embodiment of the temperature regulating system that is embedded inside the shoe. At the back, shown by number 31, a thermal actuator (e.g., a thermoelectric cooling device) is situated inside a two-segmented tank that separates the faces of the actuator from each other (e.g., hot side from the cold side.) Through a flexible (e.g., nylon) system of channels 34 temperature regulated fluid circulates on the inside walls of the shoe. This circulation is brought about by the compression of a fluid reservoir 33 situated in the bottom of the shoe. As the user walks/runs, or otherwise shifts the load of their weight, the reservoir 33 is compressed and this provides the necessary activating force for fluid circulation. A check valve 35 is placed near the compression reservoir to only allow the movement of the fluid in one direction. To further aid the thermal energy exchange between the outside environment and thermoelectric actuator, in certain embodiments a heat sink 36 is placed outside of the shoe near the actuator.

In an embodiment of the present invention, the actuation system for thermal heating and cooling of the intelligent shoe is shown in FIGS. 2*a*-2*d* and 4. The drawings represent a cooling system coupled with a heating system that produces both heating and cooling effects under a single voltage bias.

Embodiments can use a known phenomenon, including but not limited to the Peltier effect, Seebeck effect, and/or Joule/Thomson effect (collectively referred to as the temperature actuator) that utilizes a junction of two dissimilar materials to convert electrical energy into thermal energy. The thermal actuator 31 is controlled by the central processing unit 38 that collects temperature sensor 26 data using a feedback control loop set by the user's preference using a smart device 55. Referring to FIGS. 2*a*-2*d* and FIG. 9, the temperature sensor 26 senses the temperature inside the shoe (alternatively or additionally, humidity sensor 27 and moisture sensor 28 sense humidity and/or moisture, respectively; in, on, or around the shoe) and the CPU 38 communicates with the smart device 55 to know the specific set point for controlling the temperature. Referring to the embodiment illustrated in FIG. 4, the thermal actuator 31 has two electrodes 57 and 58 that have specific purpose for heating and cooling. The heating pad and cooling pad can be interchanged by changing the voltage bias to 57 and 58. In one embodiment, the heating effect can be achieved by providing a positive voltage bias to 57 and a negative bias to 58. According to the Peltier effect, one face of the thermal actuator heats up and the other end cools down and the thermal effect can be carried out using the flexible channel (or piping) system 34. In an alternative embodiment, cooling effect can be achieved as the voltage bias changes from positive to negative on electrode 57. The thermal actuator 31 turns electricity into usable thermal effect by controlling a set temperature difference between the two faces of the actuator. This fixed temperature difference can be useful to achieve optimum heating or cooling effects inside the shoe by intermittently turning the thermal actuator 31 on or off according to the user setpoint and feedback loop. It is necessary to extract the thermal effect from the thermal actuator 31 and dissipate it efficiently inside the shoe. In one embodiment, this thermal effect can be transported by keeping the thermal actuator 31 in direct contact with a water reservoir 32 as shown in FIGS. 2*a*-2*d*. The water will collect the thermal effect from the thermal actuator and transport the same inside the shoe by using a flexible channel (e.g., plastic tube) 34 embedded inside the shoe. The pumping of the water will be achieved by foot pressure by keeping another small water reservoir 33 in the heel of the shoe. In one embodiment, 32, 33, and 34 form a continuous line where water always flows in one direction using the help of a check valve 35. In another embodiment, there is no check valve, however the necessary flow of water is achieved by using the foot pressure. In one embodiment, one of the two reservoirs exchange the heat that builds up as an overall thermal effect coming from the thermal actuator to the surrounding atmosphere via air cooling. In another embodiment, the air cooling of the reservoir water can be obtained by using both of the reservoirs. To achieve the air cooling of the reservoir water, the lining of reservoir 32 and 33 can be made using copper thin plates or heat sink 36 and the outsole of the shoe can be perforated to enhance the air flow between the heat sink and surrounding air.

Figure 5:
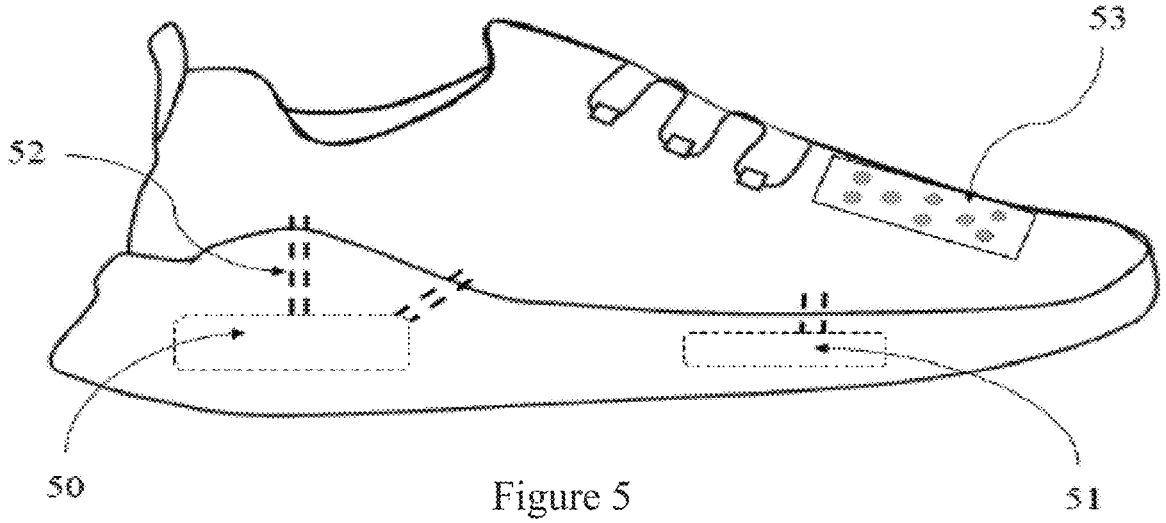
FIG. 5 schematically illustrates select components of a drying mechanism of an intelligent shoe, according to an embodiment of the present invention.
Figure 6:
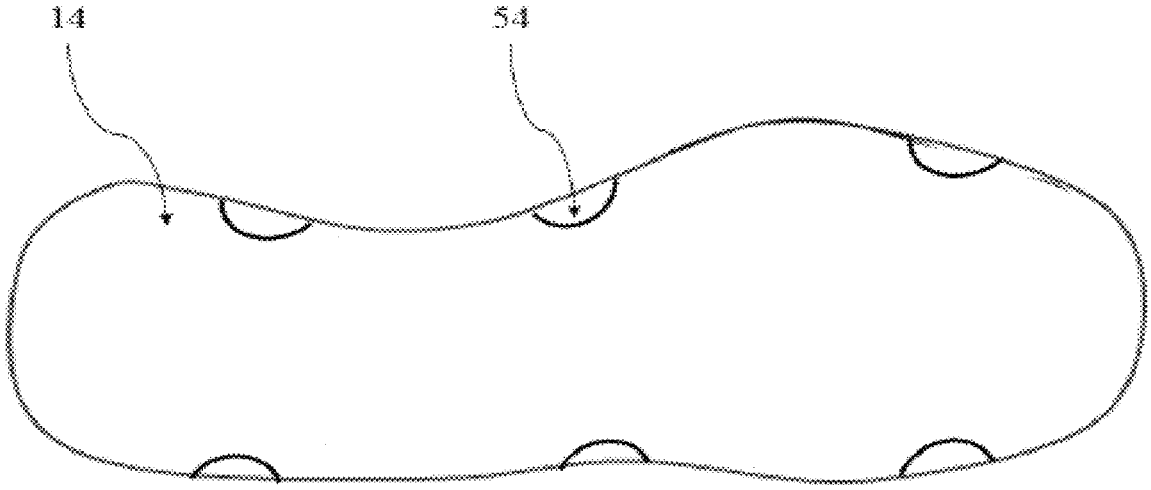
FIG. 6 schematically illustrates select components of a drying mechanism of an intelligent shoe, according to an embodiment of the present invention.

In certain embodiments the intelligent shoe 10 comes with the feature of drying that can help the user for a long term wearability of the shoe. FIGS. 5 and 6 show an embodiment of the drying mechanism for the footwear. Two separate air chambers 50 and 51 are placed in the flexible outsole 14 of the shoe that are ducted as shown from air duct openings 54 through air ducts 52 to the interior of the shoes. As the user walks/runs the chambers are compressed and the air flows out of them across the user's foot and eventually exits the shoe through vents 53 or other breathable structures, or through the opening 12 of the shoe. As the user decompresses the chambers fresh air from outside gets sucked into the shoe through the vents 53 and into the air chamber 50 and 51 for the next step of the user. This cyclic action will aid the user in drying or cooling of his/her feet.

In certain embodiments, the GPS sensor 29 provides the intelligent shoe with location service, pathfinding applications, monitoring of physical activity, and data for calculating stride length. For performing physical activities such as walking, running, and jogging; the GPS sensor can provide the distance covered and by getting the data from the pressure sensor, can calculate a more accurate step count associated with stride length. In certain embodiments the stride length advantageously employs two GPS sensors (e.g., one on each shoe in a pair of shoes) and feeding the location data of each shoe, respectively, to the smart device 55 to calculate the stride length. Alternatively or additionally, average stride length can be calculated by dividing the average distance traveled by the step counts of the user.

In certain embodiments, the intelligent shoe comes with an alert system 37 for taking numerous actions depending on the situations. One embodiment of the present invention can utilize the alert system 37 for pathfinding applications. Certain embodiments of the alert system 37 comprise a vibrating motor that can be placed in the outsole 14, insole 15, or upper 11 of the intelligent shoe. The alert system takes the command from the CPU 38 and vibrates to indicate different situations. The pathfinding application can use the alert system and GPS data combined with the user device for guiding the user. For example, while driving on a highway it is highly risky to follow the GPS guidance in smartphone based applications such as maps. This is even dangerous for beginner drivers since they are more prone to accidents if they keep their eyes out of the road for checking the guidance. Although such apps read out loud the navigation guidelines, people with poor hearing can find it difficult to listen which can make navigating complicated and dangerous in some situations. In one embodiment, the alert system in each shoe in a pair of shoes can guide the driver according to a map. In some embodiments, if the specific application requires the driver to take a right turn, the alert system at the right foot will vibrate to take a right turn and conversely the alert system at the left foot will vibrate for taking a left turn. In another embodiment, the alert system 37 will activate for example if the user is detected to be driving over a speed limit, and the alerting system 37 will send a vibration alert to the user (e.g., using information from the GPS and/or by communicating with an online mapping or navigation service) via the application used in the external device. The alert system 37 can help the novice driver for smooth operation of an automotive vehicle by sending alerts if the user accelerates too fast or brakes too hard. The alert system 37 can rely on both GPS and accelerometer data for calculating sudden increase or decrease in speed for activating the alert system. The setpoint can be regulated by the user or the application can predefine the safe acceleration and deceleration speed by referring to the standard speed for both. In alternative embodiments, the above alerts, warnings, and feedback mechanisms can be advantageously applied to walking, bicycling, and other modes of transportation.

In certain embodiments, the user can advantageously receive the same, similar, or related feedback in different modes of transportation. For example, alerting to the right foot can indicate a turn to the right in both walking and bicycling modes as determined by the user, but can be delivered with a pace and intensity determined to be advantageous for a specific mode of transport. In certain embodiments, a similar alert can be differentiated by being provided farther ahead of the turn, with greater intensity, and/or with greater frequency in a first mode of transport (e.g., when driving in an automobile) as compared to a second mode of transport (e.g., when bicycling), and yet again further differentiated as compared to a third mode of transport (e.g., when walking.) In one embodiment, alerting system 37 can be configured and adapted to provide a signal to the user (e.g., a buzzing to the right or left foot) at a first intensity and a first frequency when walking, at a second intensity greater than the first intensity and at a second frequency greater than the first frequency when bicycling, and at a third intensity greater than the second intensity and at a third frequency greater than the second frequency when driving.

There are numerous applications for such alert systems 37 such as the alert system 37 can help the user to improve their posture if the pressure mapping in both shoes are detected to be different by a certain threshold. In certain embodiments, the alert system 37 can help during a training program such as squats or lunges, to alert the user that the foot pressure is not balanced and he/she needs to correct the posture or take some corrective action to improve the training program.

Figure 7:
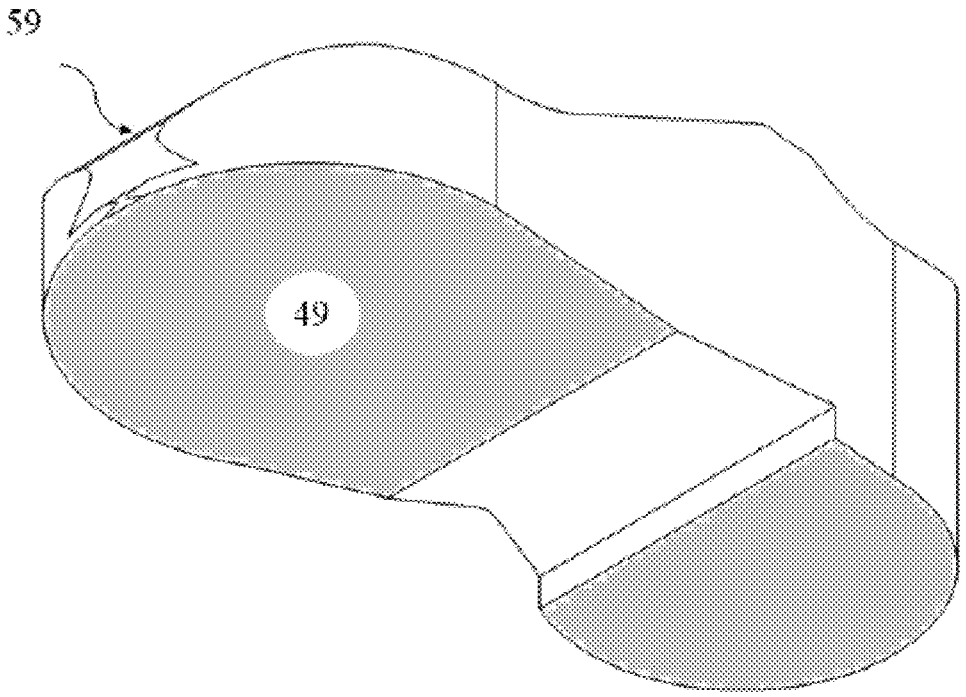
FIG. 7 illustrates incorporation of additional functional elements in a smart shoe, and an energy harvesting mechanism, according to an embodiment of the present invention.

In certain embodiments the innovative shoe comes with a headlamp spotlight system 59 as shown in FIG. 7 located in front of the shoe to help the user recognize the obstacles or tripping hazards on terrain during low light situations. The lighting panel can use LED for low power consumption that relies on a light sensor or can communicate with the external device to know specified to activate on its own. In certain embodiments, the user can also activate the light using the smart device or by sending signals through one or more sensors (e.g., accelerometer, gyro, or pressure sensors) in the shoe if there is any lighting deficiency in the ambient environment. In one embodiment, a combination of a specified sequence of motion and pressure (e.g., as determined by readings from one or more sensors either in parallel or in sequence) can be defined by the user and either selected from a predetermined list or recorded and trained from user motion (e.g., double-tapping or triple-tapping the toe of a smart shoe within a specified time period, angular orientation, and/or pressure range) as a signal to turn on various functions of the smart shoe, including but not limited to the headlamp spotlight system.

Referring to FIGS. 2*a*-2*d*, an embodiment of the intelligent shoe uses a central processing unit 38 for collecting various sensor data, actuating the thermal actuators, and communicating with the external device 55. The central processing unit 38 can be a microcontroller with low power consumption. The CPU communicates with the external device 55 wirelessly using either Bluetooth, NFC, RF communication, or Wifi module. A compact circuitry can be built having the microcontroller and the communication device, and all the sensors and actuators are connected to the central processing unit 38 in a rugged package contained within the shoe.

Referring again to FIGS. 2*a*-2*d*, an embodiment of the intelligent shoe uses an in-built power supply 39 for running all the components. An energy harvester can be used to recharge a battery or supercapacitor of in-built power supply 39, using the locomotion of the user. In another embodiment, an energy harvester 49 (e.g., piezoelectric, as seen in FIG. 7) is placed in, on, or under the outsole of the shoe to produce energy as the user walks/runs and compresses the sole of the shoe. The energy produced then gets stored in a battery/capacitor situated near the sensor. In another embodiment, flexible triboelectric energy harvesting polymers are placed on the bottom of the footwear to generate electricity as the user walks. This electricity then is transferred to a storage unit such as a battery/capacitor. In another variation of the embodiment, triboelectric energy harvesters can be coupled with the piezoelectric harvesters to generate electricity simultaneously.

FIG. 7 shows the schematic of the bottom of the shoe that has a layer of triboelectric material on the bottom. Placement of such material on the bottom of the shoe results in energy harvesting from friction between the shoe and the environment due to the user's walking.

Figure 8:
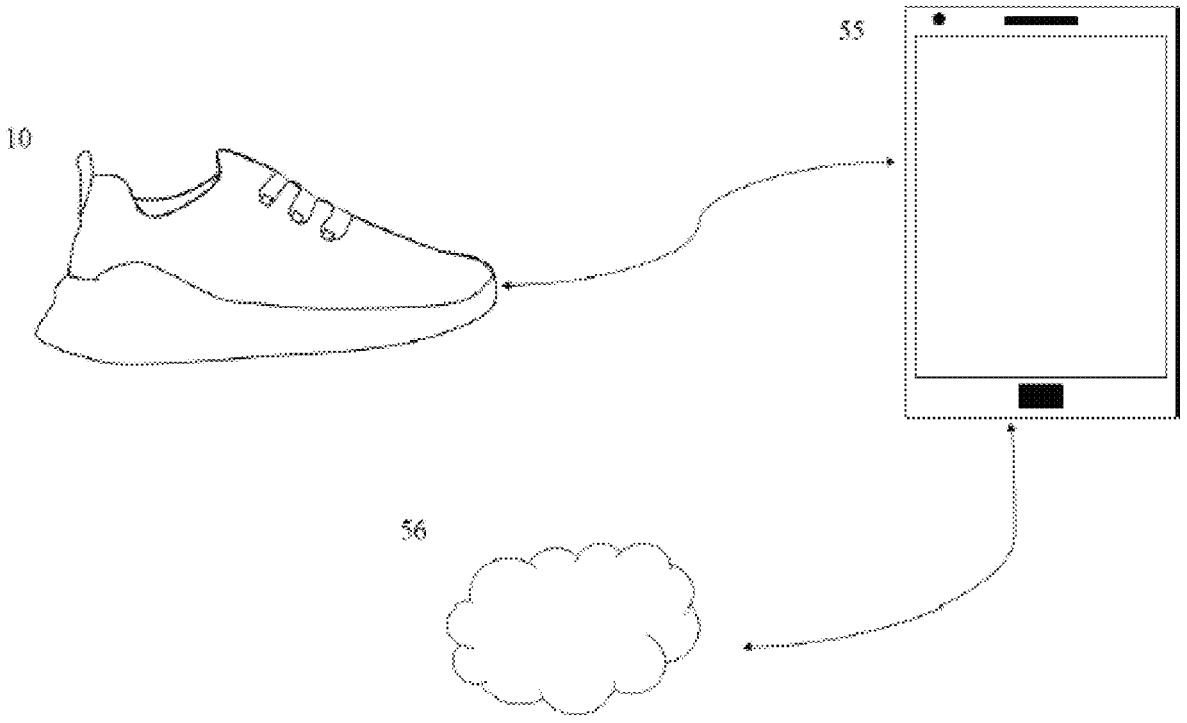
FIG. 8 illustrates an interaction between an intelligent shoe, a user device, and a cloud server according to an embodiment of the present invention.

FIG. 8 shows how the intelligent shoe 10 can communicate with the user device 55 and can store data in a cloud server 56. In certain embodiments the intelligent shoe can send information from the sensors to the user device 55 and take corrective actions if necessary according to the user preference. In some embodiments, the user configure a set point in an interactive app that is running on the user device 55, and the user device can send the command to the central processing unit 38 that can control the actuator or actuators. The user device can send important information such as age, height, weight, and sex to the cloud server 56 and track and monitor the progress. The server can also have a demo of the training exercises and can receive information from the user device regarding the training data.

Figure 9:
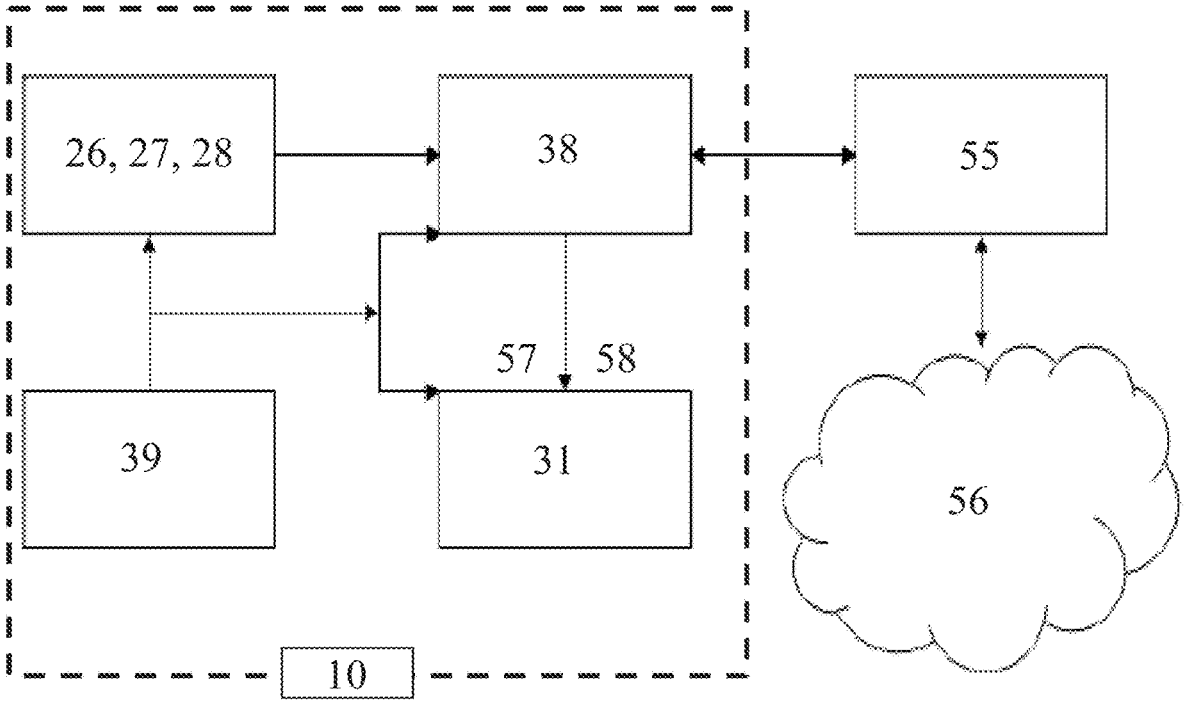
FIG. 9 illustrates a block diagram of how an intelligent shoe can interact with its components according to an embodiment of the present invention.

FIG. 9 shows how the components of certain embodiments of the intelligent shoe 10 interact with each other. For example, the sensors (e.g., 26, 27, 28, and other sensors) send signals to the CPU 38 which interacts with the user device 55 to take corrective actions such as cooling down the shoe via thermal actuator 31 via electrodes 57, 58. The user device can send and receive data from the cloud server 56 for monitoring the fitness of the user. All the components inside the intelligent shoe are powered by an in-built power supply 39.

Figure 10:
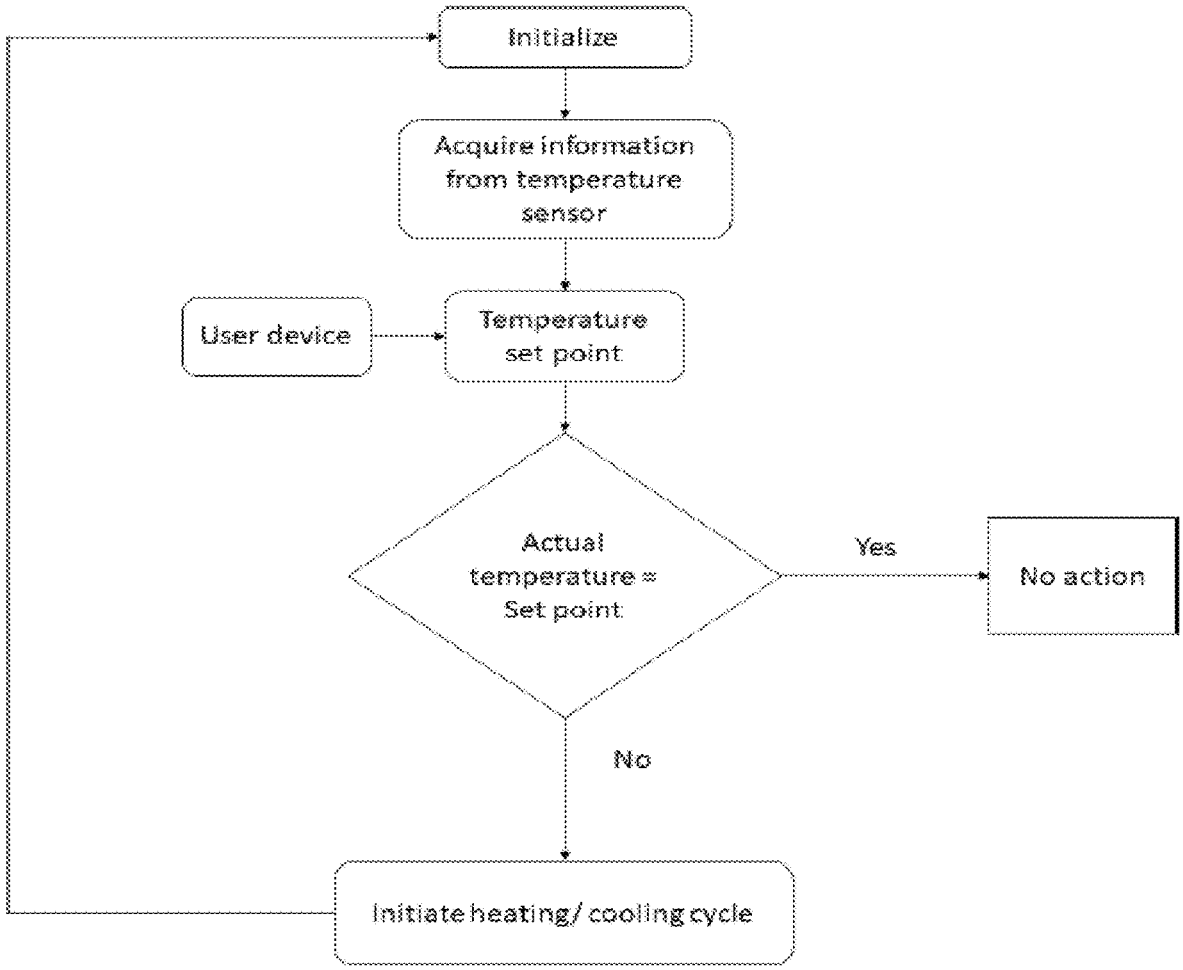
FIG. 10 illustrates a flow chart useful for operation of a thermal actuator built in inside an intelligent shoe according to an embodiment of the present invention.

FIG. 10 shows a flow chart of how the intelligent shoe regulates the temperature inside the shoe. The central processing unit gathers information from the temperature sensor and also communicates with the user device regarding the temperature set point from the user device. Based on the temperature set point, the microcontroller takes action if the temperature does not match the set point and runs the loop until the set point is reached.

Embodiments of the present invention provide intelligent automated footwear systems and methods with controllable features that provides a multiplicity of features including but not limited to smart sensing using sensors, conditioning the internal environment (e.g., temperature and humidity) of a shoe using actuators, and control systems for executing automated features. Embodiments of the smart shoe provide an ergonomic design to distribute the sensing elements across the shoe and the actuators for controlling the internal atmosphere which in some embodiments are sensed and controlled by a built-in microcontroller. Certain embodiments provide an alert system embedded in (or mounted on, or proximal to) the shoe that can alert the user (e.g., by creating a vibration signal). Embodiments of the smart shoe can wirelessly communicate with an external device using an application interface. In certain embodiments, through the provided cell phone, table, or device application, the user is able to access the health condition statistics and also set the temperature for the internal environment of the shoe. Embodiments of the present invention provide an energy harvesting mechanism to recharge the primary energy source of the provided intelligent device by using the locomotion energy of the user.

Embodiments of the present invention relate generally to intelligent electronic footwear. Particularly, embodiments of the present invention provide sensors, actuators, energy sources, and data processing for enabling AI integrated automated features of intelligent electronic shoes. Embodiments of the intelligent footwear gather information from the shoe and send the data to a user interface for monitoring the physical activities. In certain embodiments, smart thermal actuation system can control the internal temperature of the shoe to offer a comfortable experience to the user.

Embodiments provide an intelligent footwear having systems for multipurpose sensing and actuation modules, that can use energy harvested by the user locomotion or by an energy source accompanied by artificial intelligence to gather and process information for ensuring an enhanced user experience. Among the sensors, embodiments provide multiple pressure sensors, temperature sensors, moisture and humidity sensors, GPS sensor, accelerometer sensor, and additional sensors as known in the art, or as may be later developed. The foot pressure sensors can be placed at multiple locations for monitoring the weight of the user, for gait analysis, monitoring physical activities, posture analysis, and to support other beneficial analysis. The temperature sensor can monitor the temperature inside and outside of the shoe. The GPS and accelerometer sensors can track the location as well as movement of the user. The sensors can be equipped with the shoe by placing them in different places that favor the optimum sensing performance from each sensor. In certain embodiments, the same types of sensors can be used at different locations to provide a better sensing performance. Embodiments provide a thermal actuator module for controlling the temperature inside the shoe. In certain embodiments, the thermal actuation module provides a complex organization of thermal actuator, water reservoirs, flexible nylon channeling, check valve, and a heat sink configured and adapted to function as a thermal energy exchanger. The thermal actuation module can be controlled by taking the feedback from the temperature sensor and humidity and moisture sensor. The intelligent shoe can also employ an alert system disposed inside the shoe for alerting the user in certain circumstances. Each one, or all, of the provided components can be connected to a controller module which can be powered by a rechargeable battery, supercapacitor, or capacitor. The battery can be recharged externally as well as by an energy harvester using the locomotion of the user. All of these components can be controlled by a controller module and the controller module can communicate with an external user device such as smartphone and smartwatch. In certain non-limiting and exemplary embodiments, the user can monitor the physiological activities on the monitor of the user device, the user or the device can control the set point for temperature control, and can track certain physiological activities such as workouts, training, or exercise sessions.

Embodiments provide an intelligent footwear having the capability to sense and regulate the interior temperature to increase comfort and performance.

In certain embodiments, the intelligent footwear provides an embedded energy harvester that renders the system energetically self-sufficient.

In certain embodiments, the intelligent footwear provides a self-drying mechanism coupled with temperature regulation configured and adapted to reduce moisture, humidity, and discomfort.

In certain embodiments, the intelligent footwear provides monitoring of physical activities for posture correction and/or rehabilitation as well as usages in sports science for athlete performance enhancement through a smart device (e.g., smartphone, smartwatch, internet of things (IOT) edge device, computer, laptop, cloud server, distributed computing system, or the like.)

Wearable flexible piezoresistive pressure sensors hold wide-ranging potential in human health monitoring, electronic skin, robotic limbs and other human-machine interfaces. Out of the most successful recent efforts for arterial pulse monitoring are sensors with micro-patterned conductive elastomers. In related art systems, however, low current output signal (typically in the range of nanoamperes), bulky and expensive measurement equipment for useful signal acquisition inhibits their wearability. Through finite element analysis the inventors have established a set of design rules for a highly sensitive piezoresistive pressure sensor with output that is high enough to be detectable by simple and inexpensive circuits to ensure wearability. For example, embodiments can provide normalized current change (defined as a unitless ratio of change in current divided by initial current) greater than or equal to 0.05, alternatively 0.1, 0.25, 0.5, 0.75, 1, or more than 1 per unit increase in pressure (measured in kilopascals (kPa)). Alternatively, embodiments can provide current (measured in amperes (A)) greater than or equal to 0.05, alternatively 0.1, 0.25, 0.5, 0.75, 1, or more than 1 A per unit increase in pressure (measured in kPa). Certain embodiments are beneficially configured and adapted to produce a linear relationship between pressure and either current, normalized current change, or both; advantageously enhancing ease of computation and calibration for simple and low cost control mechanisms using such sensors as input.

The inventors have discovered that out of four frequently reported micro-feature shapes in micro-patterned piezoresistive sensors, micro-dome and micro-pyramid shapes advantageously yield the highest sensitivity. Through investigations of different conductivity values of micro-patterned elastomers, the inventors also discovered that coating the elastomer with a conductive material (e.g., a metallic coating) leads to higher current response when compared to composited conductive elastomers. Additionally, uniquely advantageous geometric parameters and spatial configurations of micro-pyramid design of piezoresistive sensor have been discovered. Surprisingly, certain embodiments of the present invention provide enhanced sensitivity and higher current output by advantageous application of a lower spatial density configuration (e.g., 3 micro-feature per millimeter length), smaller feature characteristic size (e.g., around 100 μm in length), and moderately low (e.g., 60-50 degrees) pyramid angle.

Related art micro-fabricated piezoresistive sensors are not optimized to achieve higher signal to noise ratio. Related art piezoresistive pressure sensors give low output signal levels necessitating the use of complex and unwearable signal acquisition devices for interpreting the signals. The inventors of embodiments of the subject invention used novel, broad, and systematic computer simulations (unrestrained by the ease of micro-fabricatability) to obtain favorable design parameters for the sensor to exhibit higher signal-to-noise ratio output. This leads to wearable and compact form-factor signal acquisition devices for use in detection of weak physiological signals such as the heart's pulsewave from the wrist.

Related art devices include numerous instances were micro-cone, micro-pillar, or other unfavorable parameters were used. Thus, there is a lack of direction towards choosing all possible parameters of the design to achieve the highest potential for the sensitivity and signal-to-noise ratio. The reason for lack of such direction lies in the fact that related art devices do not develop wearable signal acquisition platforms for sensors or conduct tests with bulky laboratory equipment such as sourcemeters. Therefore, sensor sensitivity and signal-to-noise ratio improvement tactics such as design optimization are necessary if the goal is to pair with wearable signal acquisition platforms (lower processing power).

The identification of the fabrication approach and material selection for embodiments of the subject invention was challenging. The microfabrication was chosen due to its robustness capability. The fabrication process was designed to achieve the desired structure in a low number of steps (e.g., spin coating, development, dry etching, wet etching, demolding, sputtering, and finally deposition of graphene at the end). Materials selection was based on simulation results (enough conductivity), biocompatibility, and required mechanical characteristics.

One challenge was that a film of photoresist of AZ1518 showed unevenness and bubbles after the spin coating. In order to address this, the spin coating process was altered in a way that the wafer was completely covered by photoresist before spinning action begins (in contrast to the procedure that instructs gradual application photoresist to the wafer while it is in rotation). This measure resulted in a more uniform final coating compared to the usual procedure for the specific photoresist (AZ1518) used. Another challenge was that dry (and wet) etching of the wafer would uniformly and completely eliminate the nitride layer (silicon wafer in shape of pyramid pits). In order to address this, in reactive ion etching (RIE) the time and parameters of the process were adjusted by regular observation under the microscope and then adjusting the parameters (time, pressure, etching gas flow rate). The same strategy was applied during the final wet etching process, updating the parameters and observation of the wafer during the process. Specifically, the temperature of the hot bath had to be continuously be monitored and adjusted. Also, the orientation of the wafer under etching had to be upside down to allow for complete etching inside the narrow pits. It should be noted that technical parameters described above are not readily available because they are specific to the equipment, material, and the design used. Another challenge was demolding of the thin (100 μm) micro-featured polymer was difficult because it would tear because of its thinness. The action of realization of a polymer part with micro-features utilizing the fabricated mold (demolding) was challenging due to the thinness of the polymer part and adhesion of the polymer to the mold after curing. In order to address this, the process changed for this purpose by application of a chemical (TRICHLORO(1H,1H,2H,2H-PERFLUOROCTYL) silane) in vacuum desiccator to ease the detachment of polymer from the mold. Moreover, the curing of the polymer was done in temperatures below 50° C. to prevent or inhibit adhesion of the polymer to the mold. Another challenge was that the highly sensitive sensor was not durable at first and after some time it would show degradation in the output. Although the sensitivity of the sensor made by sputtering of gold was excellent, it was not durable at first as gold coating on top of the PDMS would crack and in some localized parts would peel off. In order to address this, retaining the conductive coating on top of the micro-patterned polymer was realized by an additional step of depositing a layer of reduced graphene via single step bipolar exfoliation of graphite on top of the micro-pyramid side. The layer would act like a net on top of the gold coating providing conductive paths circumventing the cracks and also mechanically retaining the gold coating in its place.

In related art, various structures and sensing materials have been proposed to achieve highly sensitive piezoresistive pressure sensors (e.g., based on elastomers, such as conductive polymeric films or composites with distinct structural schemes such as micro-pyramids, micro-domes, micro-pillars, and micro-cones). However, the lack of parametric understanding and lack of design rules for fabrication of these microstructures inhibits achievement of the highest available sensitivity in the lowest required footprint area.

Although there have been successful piezoresistive pressure sensors, achieving sufficiently high levels of sensitivity (e.g., as required to detect human pulse wave, sound wave, or subtle pressure changes caused by object manipulation) remain challenging. In almost all cases, output of the sensors when measuring weak physiological signals such as pulse from the wrist are in range of nanoamps (nA). In related art systems, researchers need to utilize source meters (e.g., Keithley 2400 Series SourceMeter from Tektronix, Inc., Beaverton, Oreg.) or equivalent signal acquisition devices which are typically desktop-sized devices to generate useful response of the piezoresistive sensors for these applications. Usage of such devices as an overlooked necessary element of these pressure sensor systems is not compatible with the wearability claim which is frequently made with respect to related art systems.

Embodiments of the present invention optimize the microstructure's geometric parameters and spatial configuration to achieve high sensitivity and signal level, so that reliance of the sensor response read-out on complex and unportable measuring devices such as source meters is no longer required. Higher signal level is especially beneficial since it increases the signal to noise ratio which improves signal acquisition for the sensor with simple electrical circuitry. High enough signal-to-noise ratio also allows straightforward signal amplification which is a necessary step for detection of weak physiological human signals (e.g., pulse waveform from the wrist, or subtle changes in foot contact pressure) using miniaturized and inexpensive circuits which can be integrated to wearable platforms.

Embodiments of the subject invention address the technical problem of sensing, evaluating, analyzing, controlling, and providing user feedback based on user requirements and sensor parameters related to pressure sensors and/or environmental sensors in a smart shoe being challenging, expensive, and requiring bulky and non-wearable or non-portable equipment. This problem is addressed by providing digital signal processing of sensor inputs to control one or more actuators or alert systems, in certain embodiments combined with or influenced by user inputs, to efficiently and effectively manage, analyze, or influence one or more physical parameters correlated with user comfort, performance, or function in relation to the smart shoe. In certain embodiments, a machine learning or AI method applying a combination of advanced techniques is utilized to enhance or improve the user comfort, performance, or function in relation to the smart shoe.

The transitional term "comprising," "comprises," or "comprise" is inclusive or open-ended and does not exclude additional, unrecited elements or method steps. By contrast, the transitional phrase "consisting of" excludes any element, step, or ingredient not specified in the claim. The phrases "consisting" or "consists essentially of" indicate that the claim encompasses embodiments containing the specified materials or steps and those that do not materially affect the basic and novel characteristic(s) of the claim. Use of the term "comprising" contemplates other embodiments that "consist" or "consisting essentially of" the recited component(s).

When ranges are used herein, such as for dose ranges, combinations and subcombinations of ranges (e.g., subranges within the disclosed range), specific embodiments therein are intended to be explicitly included. When the term "about" is used herein, in conjunction with a numerical value, it is understood that the value can be in a range of 95% of the value to 105% of the value, i.e., the value can be +/−5% of the stated value. For example, "about 1 kg" means from 0.95 kg to 1.05 kg.

The methods and processes described herein can be embodied as code and/or data. The software code and data described herein can be stored on one or more machine-readable media (e.g., computer-readable media), which may include any device or medium that can store code and/or data for use by a computer system. When a computer system and/or processor reads and executes the code and/or data stored on a computer-readable medium, the computer system and/or processor performs the methods and processes embodied as data structures and code stored within the computer-readable storage medium.

It should be appreciated by those skilled in the art that computer-readable media include removable and non-removable structures/devices that can be used for storage of information, such as computer-readable instructions, data structures, program modules, and other data used by a computing system/environment. A computer-readable medium includes, but is not limited to, volatile memory such as random access memories (RAM, DRAM, SRAM); and non-volatile memory such as flash memory, various read-only-memories (ROM, PROM, EPROM, EEPROM), magnetic and ferromagnetic/ferroelectric memories (MRAM, FeRAM), and magnetic and optical storage devices (hard drives, magnetic tape, CDs, DVDs); network devices; or other media now known or later developed that are capable of storing computer-readable information/data. Computer-readable media and machine-readable media should not be construed or interpreted to include any propagating signals. A computer-readable medium of embodiments of the subject invention can be, for example, a compact disc (CD), digital video disc (DVD), flash memory device, volatile memory, or a hard disk drive (HDD), such as an external HDD or the HDD of a computing device, though embodiments are not limited thereto. A computing device can be, for example, a laptop computer, desktop computer, server, cell phone, or tablet, though embodiments are not limited thereto.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to embodiments of the invention.

Example 1: Three Dimensional (3D) Finite Element Method (FEM) Analysis of Sensor Design Objectives In related art several attempts of designing and optimization via modelling of piezoresistive pressure sensors have been made; however, they are all limited to detection of gas pressure by incorporating a sensitive diaphragm. Currently, there has been no successful design optimization of contact piezoresistive pressure sensors suitable for mounting on the skin or in a wearable device (e.g., a smart shoe) to detect weak human physiological signal(s) (e.g., pulse, blood pressure, or slight variations in contact pressure force across regions of the foot) via a completely wearable system. The inventors have advantageously employed finite element method (FEM) analysis to study the required microstructure shape, spatial configuration, and sensing material characteristics to detect weak human physiological signal(s) via a completely wearable system. Three dimensional (3D) simulations provide realistic analysis of the effects that (1) various micro-feature shapes have on piezoresistive sensor sensitivity, (2) different conductivity values of micropatterned elastomer features have on sensor current output level and sensitivity, and (3) design parameters of a micro-patterned sensor (e.g., micro-pyramid) including spatial number density, size, and angle have on sensitivity per required footprint area.

FEM Model Setup

Figures 11A, 11B:
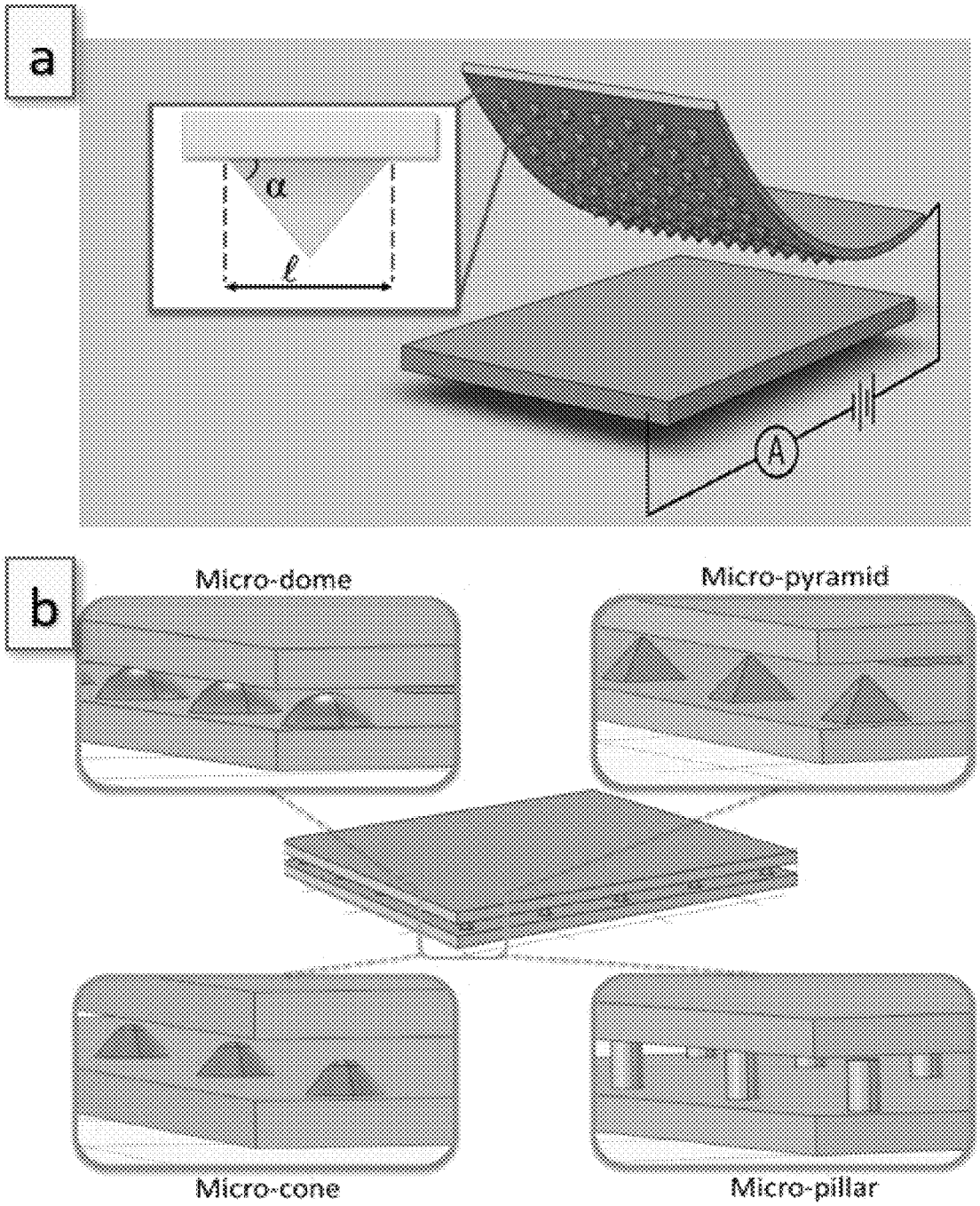
FIG. 11*a* schematically illustrates a micro-pyramid piezoresistive sensor showing parameters such as pyramid angle "α" and pyramid base size "l"
FIG. 11*b* schematically illustrates provided micro-feature shapes for a three dimensional 1.8 millimeter (mm)×1.8 mm piezoresistive sensor according to embodiments of the present invention.

A computational model of a piezoresistive pressure sensor to simulate electrical output signal while the sensor undergoes compression was developed using COMSOL Multiphysics (COMSOL, Inc., Burlington, Mass.) in order to solve the controlling partial differential equations by finite element technique. The inventors considered steady state modeling to analyze the maximum signal level that the sensor is capable of outputting. A 3D computational model of a square shaped pressure sensor is proposed. This modeling is proposed to simulate and study the micro-feature deformations due to pressures ranges experienced similar to the pulse wave from a human wrist. This pressure is reported to range from 1 to 10 kPa depending on the test-subject's characteristics. The schematic design of a pressure sensor is shown in FIG. 11*a*. The sensor consists of a flexible hyper-elastic micro-patterned layer and a conductive current collector layer both facing each other. Various micro-feature shapes, namely micro-pyramid, micro-cone, micro-dome, and micro-pillar were selected for simulation based on the frequently reported microfabricated pressure sensors (FIG. 11*b*). 3D simulations were run to study the influence of various micro-feature shapes on the sensor's sensitivity (which is defined as relative current change vs. applied pressure). In addition, dependence of the sensor response on conductivity of the flexible polymeric layer and micro-feature geometric dimensions were evaluated using 3D and 2D modeling.

Geometric parameters such as angle, base size, and spatial configuration for one of the frequently reported shapes in the literature (i.e., micro-pyramid) is chosen to optimize the micro-feature parameters. It should be noted that results obtained from such simulations is not exclusive to micro-pyramid and can also be expanded to other micro-feature shapes. Specifically, 2D modeling were used to find the optimum angle ($\alpha$), base size (l) (FIG. 11*a*), and micro-feature number density (the number of micro-features per unit length) of the pressure sensor in order to achieve enhanced sensitivity.

TABLE 1

Simulation parameters

| Parameter | Micro-patterned Layer | Current Collector Layer | Reference* |
|---|---|---|---|
| Feature Angle (z) | 57.4 degrees | N/A | [38] |
| Feature Base Size (l) | 100 μm | N/A | N/A |
| Feature Spacing | 300 μm | N/A | N/A |
| Array | 5 × 5 (low number density setup) | N/A | N/A |
| Footprint | 1.8 × 1.8 $mm^2$ | 1.8 × 1.8 $mm^2$ | N/A |
| Conductivity | 1 × $10^5$ S/m | 46 × $10^6$ S/m | [39] |
| Young's modulus | 750 kPa | 70 GPa | [39, 40] |

TABLE 1-continued

Simulation parameters

| Parameter | Micro-patterned Layer | Current Collector Layer | Reference* |
|---|---|---|---|
| Poisson's ratio | 0.49 | 0.44 | [39, 40] |
| Density | 970 $kg/m^3$ | 19300 $kg/m^3$ | [39, 40] |
| Relative Permittivity | 2.75 | 1 | [39, 40] |

*The following references are hereby incorporated herein by reference in their entireties: S. Franssila, Introduction to Microfabrication, 2010; R. Serway, J. Jewett, Principles of Physics, 1998; J. Brandrup, E. Immergut, E. Grulke, A. Abe, D. Bloch, Polymer Handbook, 1999.

In this example, finite element analysis via COMSOL Multiphysics was used to derive the design rules for a sensitive and wearable microfabricated piezoresistive pressure sensor. COMSOL Electric Currents (ec) interface from the branch AC/DC>Electric Currents (ec) coupled with Solid Mechanics module was used to solve the differential form of Maxwell's equations considering simulation parameters reported in Table 1.

Equations

In the FEM tool used in this example, models are described in terms of the partial differential equations for the underlying physical laws. Conservation of charge in the volume of the sensor dictates the rate at which the charge flows in/out of the sensor must be equal to the rate it increase/decreases inside the volume. This notion is mathematically expressed by equation of continuity as:

$$\nabla \cdot J = Q_{j,v} \quad \text{(Eq. 1)}$$

where J is the current density, and $Q_{j,v}$ is electric charge density's $2^{nd}$ order matrix. Also, the current density is calculated by equation below, $$J = \sigma E + J_e \quad \text{(Eq. 2)}$$

where $\sigma$ is electric conductivity of the material (of sensing layer and the current collector layer), E is the electric field strength, and $J_e$ is the current density of an externally generated current. As seen below, electric field strength (E) is a function of the electrical potential (V):

$$E = -\nabla V \quad \text{(Eq. 3)}$$

These equations are solved by finite element method with numerically stable edge element discretization combined with solution of sparse equation system.

Modeling Setup

The provided sensor setup comprises two layers. A first layer is a flat conductive substrate as current collector and a second layer is an elastomeric PDMS substrate studded with micro-features. Consider an array consisting of 5/5 of equally spaced micro-features having each a footprint area equivalent to 100×100 square micrometers ($\mu m^2$). The total size of the sensor designed to be 1.8×1.8 square millimeters ($mm^2$) in order to realistically model a pressure sensor that overlies on top of the radial artery which is reported to have diameter of about 2.3 millimeters (mm) in human wrist area. The micro-featured layer is placed facing the current collector layer so that application of an external force causes the micro-features to deform and lead to an increase of the contact area between the layers (FIG. 11*a*). In this simulation, formerly mentioned external forces are applied in such a way that each layer gets closer to the other 0.5 micrometer per step. In a series of 24 steps the layers are increasingly pushed against each other causing measurable deformations on the tip of the micro-features (i.e., contact point between the two layers). This deformation leads to decreases in electrical resistance between the layers. When an electrical potential difference is applied between these two layers, the passing current bridging the layers varies depending on the amount of contact area change which is caused by externally applied pressure.

In the first series of simulation modeling, the effect of different micro-feature shapes on current change versus applied pressure (sensor response) was studied. Specifically, the elastomeric layer is studded with micro-feature shapes of dome, pillar, pyramid, and cone as shown in FIG. 11*b*. Secondly, the influence of the sensing material's conductivity on the sensitivity and the level of the current was studied. To study the electrical conductivity of various available sensing materials, such as CNT incorporated PDMS to Gold coating, different conductivity values were assigned to the elastomeric layer (1 Siemen per meter (S/m) to 105 S/m). And finally, in the third series of simulations which was done in 2D, a micro-feature shape, namely micro-pyramid, was chosen and its geometric dimensions and spatial arrangements were optimized. The relevant materials data of the simulation setup is summarized in the Table 1.

Modeling Assumptions and Boundary Conditions

Several assumptions that were made in this simulation are as follows. 3D simulations were utilized for realistic analysis of the effects that various micro-feature shapes have on sensor response. But due to the high volume of calculations, parameters consisting of angle, base size, and number density of micro-pyramid design were optimized by two-dimensional (2D) simulations. The effect of temperature and humidity variation of conductivity is assumed to be insignificant. Moreover, the materials properties assigned to each layer is uniform throughout that layer, and there are no localized variations. Rather than assuming that a coat of conductive material is deposited on micro-features in the flexible sensing layer, the whole layer is considered to be conductive (with different values of conductivity to represent different values associated with the available sensing materials). The micro-patterned flexible layer modelled to have the conductivity of a sputtered 200 nm thick gold coating (experimentally verified to be 0.1 times of the pure gold's conductivity). The compressive force is applied normally and uniformly to the elastomeric layer to compress it against current collector layer which is rigid and fixed in space. This flexible layer is modeled to exhibit hyperelastic behavior, while nearly incompressible according to Mooney-Rivlin material model. Finally, an electrical potential difference of 1 Volt (V) is applied between the two layers by assigning ground to the flexible layer and +1 V to the current collector layer for generation of passing current between the layers (FIG. 11*a*).

Influence of Micro-Feature Shape

Figure 12A:
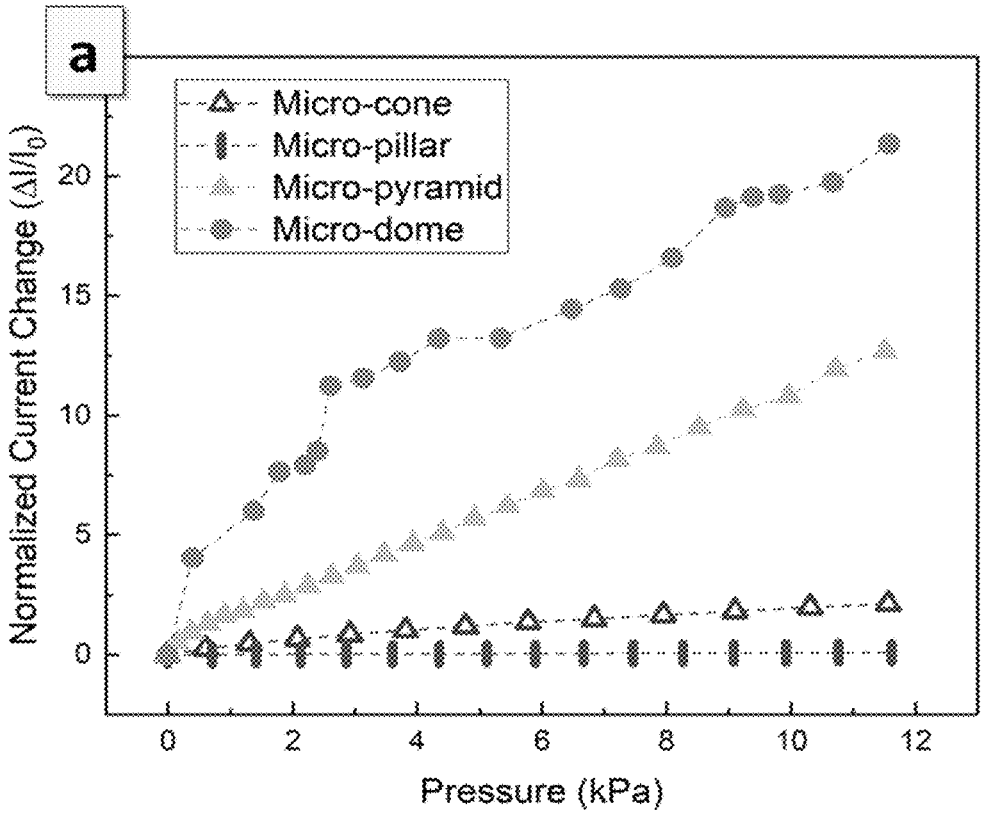
FIGS. 12*a*-12*d* illustrate simulation results for a three dimensional pressure sensor according to embodiments of the present invention.
Figure 12B:
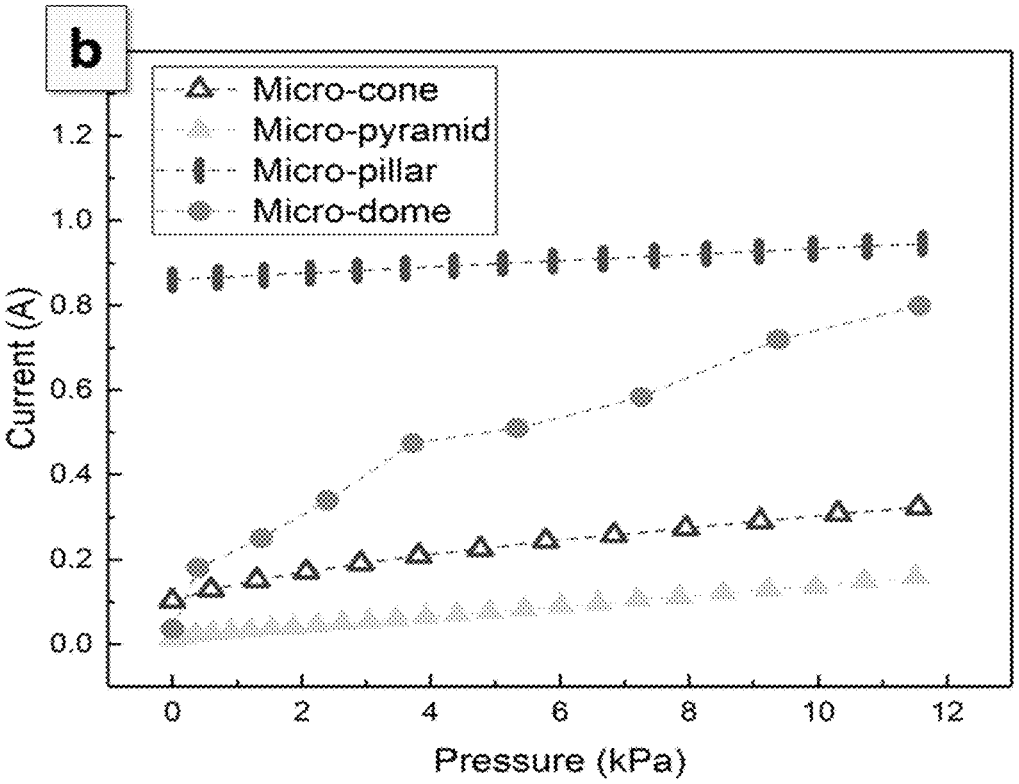

FIGS. 12*a*-12*b* shows the result of the simulations studying the effect of different micro-feature shapes on the sensitivity of the sensor when the footprint area of each micro-feature and the distance to the neighboring micro-feature remains constant (100×100 $\mu m^2$ and 3 $mm^{-1}$, respectively). Initially, slight pressure between the micropatterned layer and the current collector layer establishes a minimal contact area that allows electrical contact between the layers causing an initial current response ($I_0$). As the pressure gradually increases on the sensor the localized deformations lead to increased contact area between the two layers. Depending on the shape of the micro-features in the elastomeric layer, the rate at which the contact area increases with applied pressure varies. Due to geometrical differences associated with different shapes the linearity, sensitivity, and the current level response of the sensor can vary.

Figures 2A, 2B, 2C, 2D:
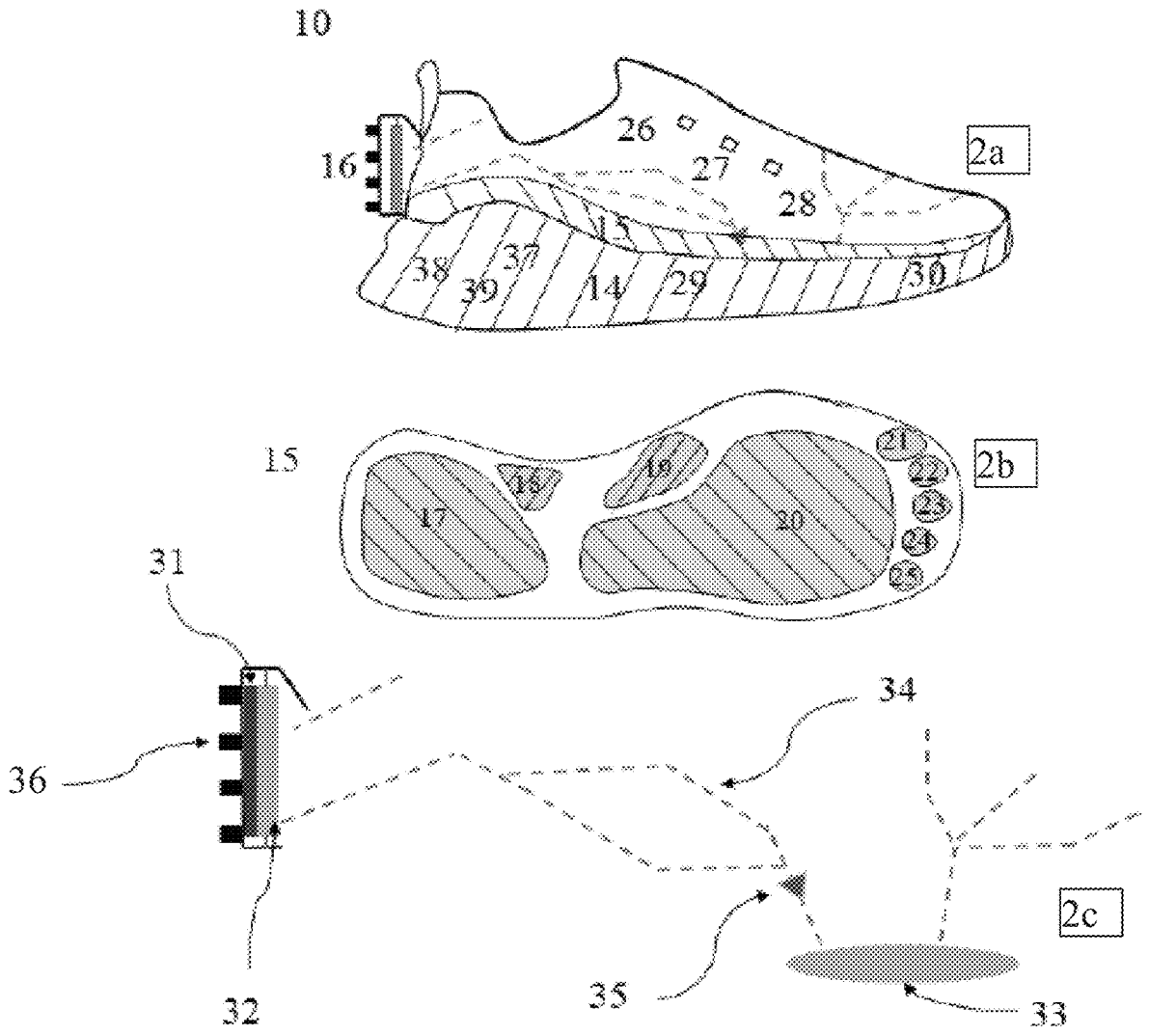
FIGS. 2*a*-2*c* schematically illustrate component placement with respect to a side view (FIG. 2*a*), insole (FIG. 2*b*), and thermal/fluid flow connection diagram (FIG. 2*c*) within a smart shoe, according to an embodiment of the present invention.

FIGS. 12*a* and 12*b* show the results of 3D modelling of four different sensors with the same size but distinct micro-feature shapes. As the pressure pushing the layers against each other increases from 0 kPa to 12 kPa, the response from micro-dome shows the highest slope which translates to highest sensitivity among all the proposed shapes. Furthermore, the frequently reported micro-pyramid design also displays a good sensitivity in the range mentioned. Other designs namely micro-cone and micro-pillar show lower relative sensitivities; however, the latter shows a higher initial current response which can be useful in applications such as switch type pressure sensors with digital mode of operation. Linearity in a sensor is desired because of both the mathematic simplicity that allows for sensor's response prediction, and also enabling the detection of an irregular sensor response. Although micro-domes offer excellent sensitivity, they do not offer linear response. On the other hand, micro-pyramid arrays exhibit clear linearity with acceptable sensitivity. Other micro-feature shapes also show linearity however they lack the high sensitivity of micro-pyramid design (FIG. 2*b*).

Figure 12D:
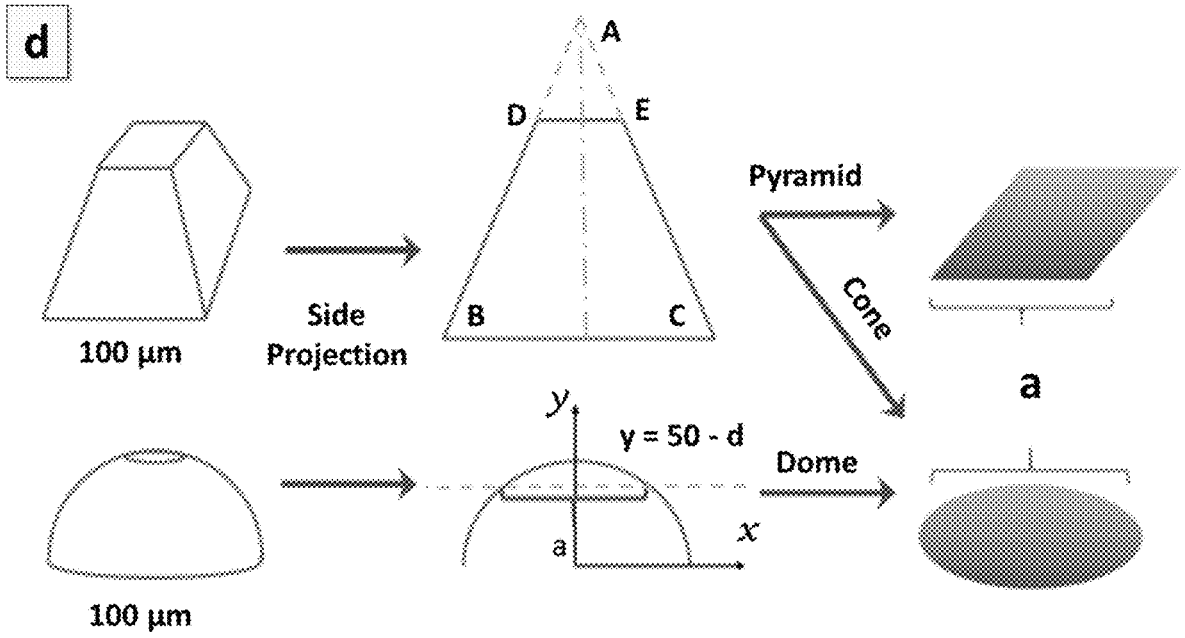
Figures 13A, 13B:
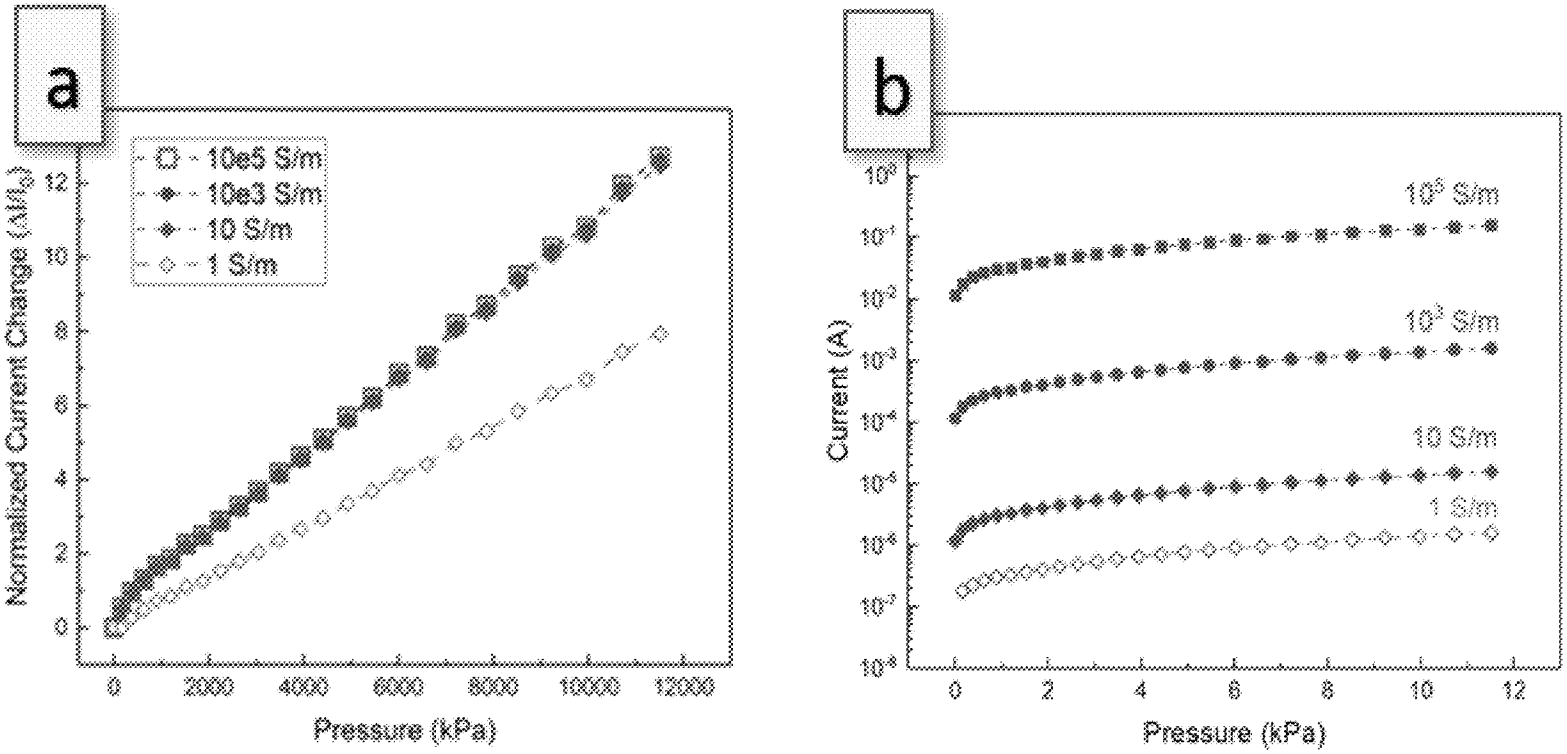
FIG. 13*a* illustrates change in relative current as a function of applied normal pressure.
FIG. 13*b* illustrates current response of a sensor with different conductivity values for sensor designs according to embodiments of the present invention.

In order to further explain why micro-feature shapes have the abovementioned effects on the sensor's response, an analytical reasoning is provided as follows. Considering micro-pyramid as an example of a micro-feature in micropatterned piezoresistive sensors, the Thales theorem describes the relationship between the shape and the contact area change when the sensor undergoes compression as the result of its operation (FIGS. 13*a*-13*b*). Because at low pressure ranges (0 kPa-12 kPa) compression force only causes rather minimal deformations at the tip of the micro-feature it can be deduced that the side projection of a pyramid is deformed simply from a triangle into a trapezoid (FIG. 13*a*). As a result, Thales theorem (Equation 4) can be applied to the initial and the final shapes after the compression to find a mathematical relation governing how length "a" (represents the length of the contact area) changes when the sensor is deformed under compression (FIG. 12*d*). Thus, considering the Thales theorem (Equitation 4) and FIG. 12*d*, the relationship between "a" (the width of the flattened tip area) and "d" (displacement of top layer against elastomeric layer) can be mathematically expressed as Equation 5.

$$\frac{DE}{BC} = \frac{AD}{AB} = \frac{AE}{AC} \quad \text{(Eq. 4)}$$

$$\frac{\frac{1}{2} \times a}{\frac{1}{2} \times \ell} = \frac{d}{\frac{1}{2} \times \ell \times \tan\alpha} \quad \text{(Eq. 5)}$$

It can be seen that for a pyramid with a chosen angle of 60 degrees (a), the relationship between "a" and "d" is established by trigonometry. And from the FIG. 12*d*, it can be perceived that the contact area between the layers is in form of a square whose sides have length of "a". Therefore, simply the contact area of a pyramid micro-feature (Sp) is given by Equation 6. Similarly, for the case of a micro-cone studded sensor (also with an angle of 60 degrees), since the side projection of the micro-cone is the same as the micro-pyramid, the relationship between "a" and "d" does not change. However, the micro-cone forms a circular contact area whose diameter equals to "a". This surface area is given by Equation 7.

$$S_p = 1.3333\,d^2 \quad \text{(Eq. 6)}$$

$$S_c = \frac{\pi}{4}a^2 = 1.0472\,d^2 \quad \text{(Eq. 7)}$$

On the other hand, in the case of micro-dome structures, considering the side projection of a dome (FIG. 12*d*) and forming a system of equations as follows Equation 8. The length "a" is basically the distance between the two points of intersection of the aforementioned lines which is expressed by Equation 9. Finally, using the value obtained for "a" then the contact area of the dome which is in form of a circle is calculated by Equation 10.

$$\begin{cases} x^2 + y^2 = 50^2 \\ y = 50 - d \end{cases} \quad \text{(Eq. 8)}$$

$$a = 2\sqrt{100d - d^2} \quad \text{(Eq. 9)}$$

$$S_d = \pi(100d - d^2) \quad \text{(Eq. 10)}$$

It should be also noted that given the assumption of no lateral flow of material during compression, deformation of micro-pillar causes no contact area increase. The modest change in current response of the sensor in the simulation results is due to the lateral material flow and increase of contact pressure that leads to higher inter-layer conductivity because of microscopic surface roughness flattening. Therefore, the developed analytical relationship is in accordance with simulation results.

Figure 12C:
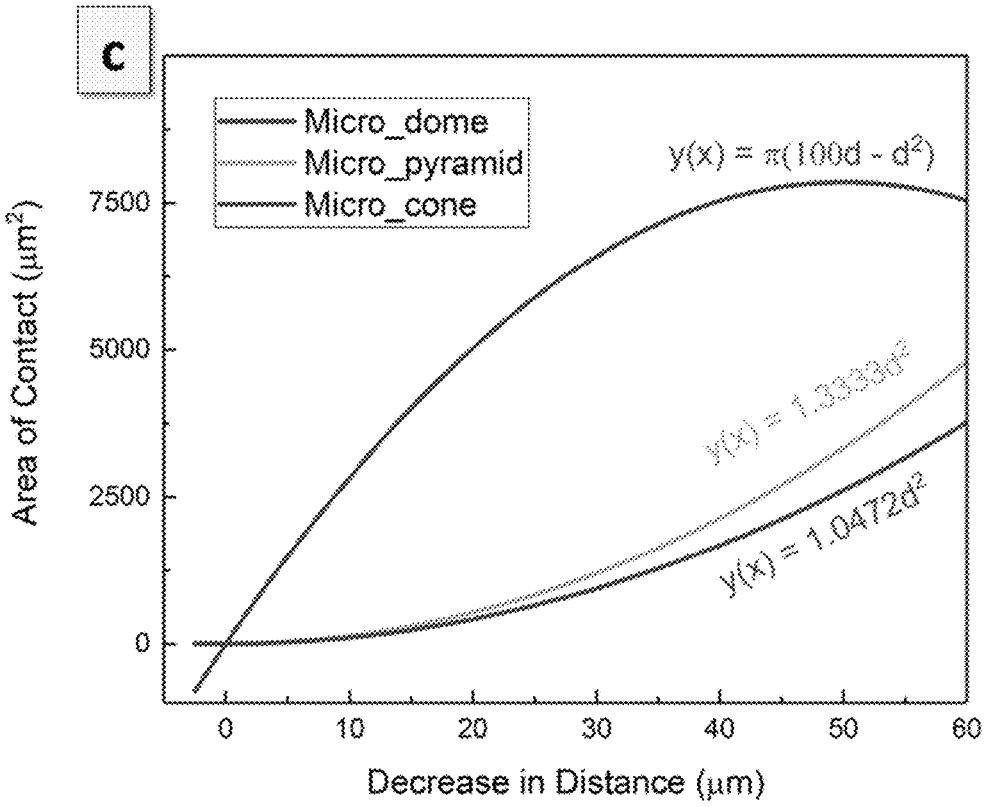

Utilizing the above developed analytical equations, the change of contact area vs decrease of layer spacing for each micro-feature shape is plotted in FIG. 12*c*. The observed trends in this plot is in accordance with the current responses seen in the COMSOL simulation results. Here, for pressure ranges of 0 kPa-12 kPa, which corresponds to 0 micrometers (μm)-20 μm of layer spacing decrease, the micro-dome's results show the steepest slope (i.e. the highest rate at which the surface area changes when the layers get closer together). Moreover, the micro-pyramid design results show a higher slope than micro-cone's which is due to the geometry of the shape as discussed before.

The Effect of the Conductivity on the Sensor's Response

Here, the sensor's response is investigated in terms of sensitivity and the passing current level with various elastomeric layer conductivities when the shape, geometrical parameters and spatial configuration of the micro-feature remains constant (pyramid, 100×100 $\mu m^2$ and 3 $mm^{(-1)}$, respectively). The simulation results show that the sensitivity of the sensor saturates at the elastomeric layer conductivity of 10 S/m and becomes independent of it. However, if the conductivity value falls below 1 S/m which is in range of conductive polymers such as carbon nano tube (CNT) infused PDMS, the sensitivity deteriorates. At these conductivity values the high resistance of the elastomeric layer serves as a limit to the passing current between the layers and thus reducing the overall sensitivity of the sensor. For this reason, in order to achieve high sensitivity in piezoresistive sensors, it is recommended that elastomeric layer be coated with a highly conductive layer such as gold or other materials that possess conductivity values higher than 10 S/m. In most cases, compositing the elastomeric layer with conductive materials leads to polymers that are not conductive enough to not adversely affect the sensitivity of the pressure sensor.

One of the most important characteristic of the piezoresistive pressure sensor is the magnitude of output signal. In this work the dependence of the sensor's output signal level on the conductivity of the elastomeric layer (sensing layer) is investigated. Through 3D simulations of piezoresistive sensor operation (FIG. 13*b*), it can be found that the higher the conductivity values of the sensing material leads to higher level of passing current with the same applied voltage (3 Volts) between the layers of the sensor. In fact, a piezoresistive sensor that is gold coated (sputtered to a thickness of 150 nanometers (nm)) exhibits a conductivity value of 105 S/m (experimentally verified) which according to the results leads current output in range of milliamps. This is practically advantageous for two reasons. First, it allows the signal acquisition with relatively simple electrical circuitry (e.g. simple and widely accessible development boards), and second, it provides higher signal-to-noise ratio which in turn allows use of amplifiers to further facilitate the signal acquisition. While several reports of composited polymer piezoresistive sensors exists in the literature, their current output signal ranges typically in nanoamperes and low microamperes in case of measuring pulse from a human wrist. This necessitates the use of relatively big, bulky, desktop-sized source meters for signal acquisition. Since most of these sensors are targeted for detection of weak physiological sensors as a wearable device, dependence of signal acquisition on bulky source meters is disadvantageous. Therefore, use of a highly conductive coating material on the flexible elastomeric layer is necessary in order to achieve high level of passing current to be detectable by truly wearable signal acquisition development boards.

Geometric Parameters Optimization

In order to investigate the how the geometric parameters of a given design can influence the sensitivity, a micro-pyramid patterned sensor with conductivity value of similar to gold ($10^6$ S/m), was chosen for investigation. Various external pressures in the range of 0-1500 Pa were applied to the sensor in this simulation. Parameters including micro-feature dimensions and spatial arrangements were studied as shown in FIG. 14*a-d*. Because of the similarities between micro-patterned pressure sensors designs, parameters optimized for one design can be readily generalized to the other micro-patterned pressure sensor shapes. Here, micro-pyramid studded sensor behavior was studied due to its similarities to other micro-patterned pressure sensors such as micro-cone, micro-dome, and micro-pillar. Therefore, sensors length of 2.1 mm with three different pyramid spatial densities consisting of low, medium, and high number density (corresponding to six, nine, and fifteen pyramids, respectively) were simulated to study the impact of micro-feature number density on sensitivity. According to the FIG. 14*b*, low number density setup data yields to the highest slope of the fitted curve which means that this setup shows the most sensitive response among all three setups. This is due to concentration of the exerted pressure at fewer pyramids. Greater deformations at these contact points results in larger contact area between the layers which in turn translates to lower resistance and higher passing current.

Figure 14A:
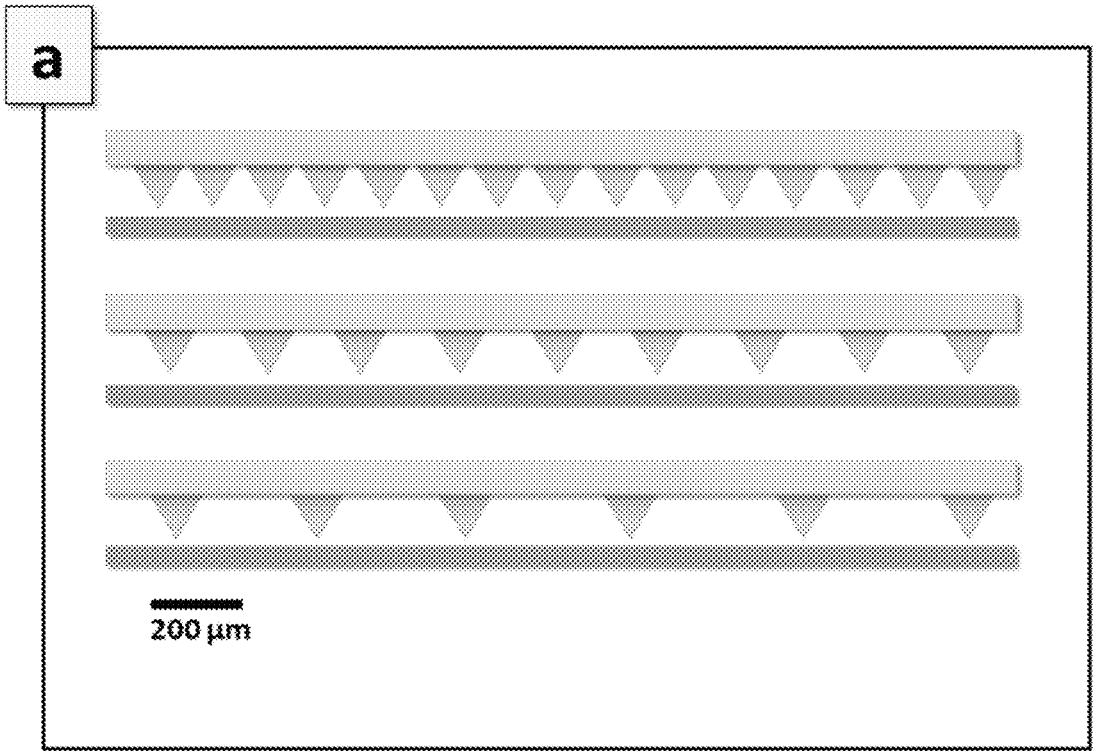
FIG. 14*a* illustrates the schematic design of a pressure sensor of different spatial densities under investigation, charting micro-pyramid geometric parameter.
Figure 14B:
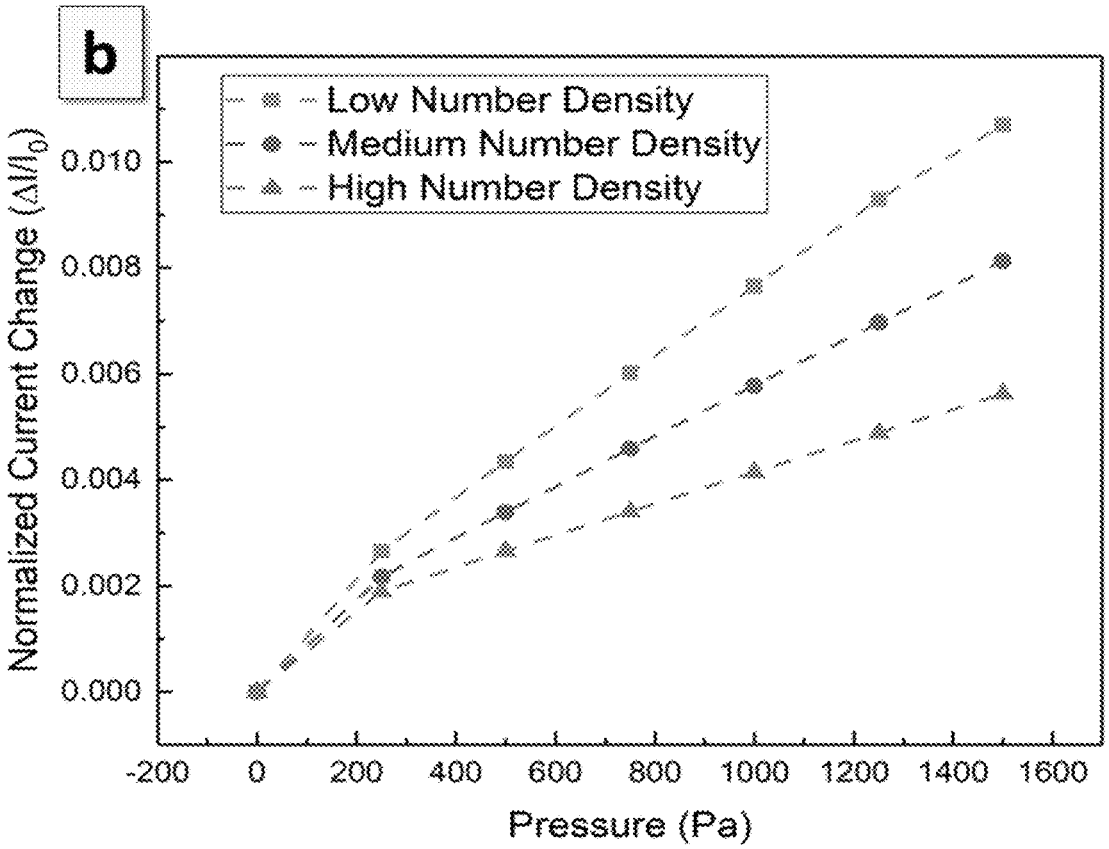
FIG. 14*b* shows configuration results in terms of relative current as a function of applied pressure for different spatial densities.
Figure 14C:
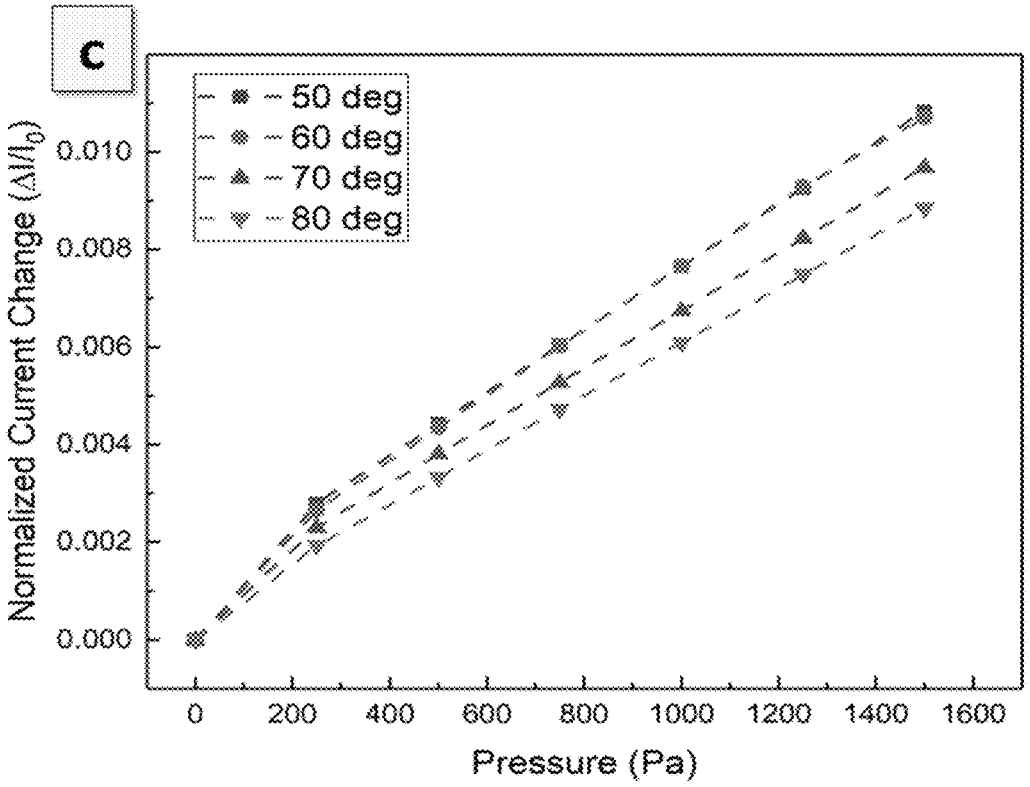
FIG. 14*c* shows configuration results in terms of relative current as a function of applied pressure for different pyramid angles "z"
Figure 14D:
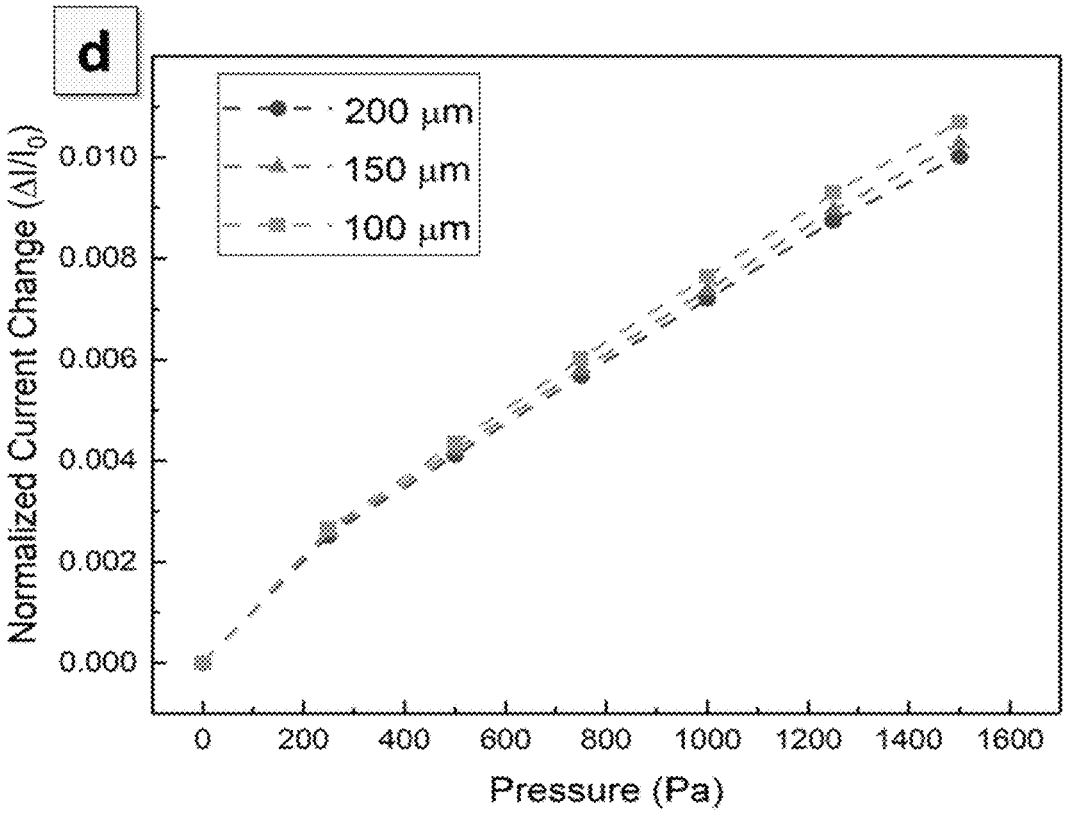
FIG. 14*d* shows configuration results in terms of relative current as a function of applied pressure for different pyramid size "l"; each respectively according to embodiments of the present invention.

In order to quantitatively compare the sensitivity arisen form setups with different pyramid angles at the same sensor length of 2.1 mm, micro-pyramid designs with angles (shown as "α" in FIG. 11*a*) between 80 to 50 degrees were studied in FIG. 14*c*. The results depict that pyramids with angles of 50 to 60 degrees show relatively a more sensitive response. The reason for this lies in a balance between the contact area growth rate (highest growth rate corresponds to 50 degrees according to the equation 6) and the amount of localized pressure at contact areas between the layers. It should be noted that in order to achieve high contact area growth rate, the localized pressure has to be high enough to enable the deformation. The highest localized pressure is typically experienced in structures with low contact area growth rate (i.e., 80 degrees). Therefore, it is logical to achieve the highest sensitivity with a sensor that is studded with 50 to 60-degree angle pyramids in which case both factors have medium and balanced influence. This is in turn in accordance with the aforementioned simulation results. Furthermore, an easier way to manipulate the design of a micro-feature studded sensor, rather than changing the angle, is to change the size of the micro-features themselves. Practically this is done by changing the microfabrication mask. To study this, simulations were conducted by changing the size of micro-features (depicted as "l" in FIG. 11*a*) with three base sizes of 100, 150, and 200 μm all with previously determined sensitive configurations which are 60-degree pyramid angle and low number spatial density. As shown in FIG. 14*d*. the normalized current change (i.e., sensitivity) increases as the sensor is compressed under external pressure. All three configurations show linear growth behavior; however, as the feature size gets smaller, specifically at 100 μm, the slope of the line increases. The higher slope of the fitted lines means higher sensitivity. This is attributed to increasing of the localized pressure because of the smaller contact areas associated with smaller feature sizes.

Out of the three above-mentioned geometric parameters, spatial number density of micro-features represents the most influential factor on sensitivity of the sensor since localized pressure experienced at the contact areas, strongly depends on the total number of points of contact between the layers. The fewer the number of contact areas (i.e., lower spatial number density), the higher localized pressure and therefore more deformation and lower electrical resistance between layers. While dimensional parameters such as base size and angle of pyramid show weaker influence on the sensitivity of the sensor, they also have to be taken into consideration in designing of highly sensitive micropatterned piezoresistive pressure sensors. Based on the findings of this work, a micropatterned piezoresistive pressure sensor for arterial pulse monitoring in contact with skin can achieve potentially higher sensitivity and signal strength if the micro-features are in the shape of domes or pyramids and they are patterned with number density of 3 $mm^{-1}$, feature size of 100 and angle of $50° < \alpha < 60°$ (in case of pyramid shape). Also, the elastomer layer has to at least have the conductivity of 10 S/m to ensure that the sensitivity does not deteriorate due to lack of conductivity. Nonetheless, as the conductivity of the elastomeric layer is enhanced to approach the conductivity of gold, the sensor signal output becomes stronger (i.e., higher current) which is favorable for detection of the signal with simple and inexpensive electrical circuits tailored for wearable applications.

In this analysis, a series of 2D and 3D simulations were conducted to compare the effect of different shaped micro-features on the sensitivity and signal level of a piezoresistive sensor. The inventors have shown that sensors with arrays of micro-domes and micro-pyramids show higher sensitivity in comparison to micro-cone and micro-pillar studded sensors. Moreover, simulations on assigning different values of conductivity provided insights that in conductivity values of the sensing layer similar to that of the gold coating the sensor achieves a high signal level response. However, if the conductivity of the sensing layer is similar to typical conductive polymers', the sensitivity suffers and the current response is low enough to inhibit the practical use of the sensor due to low signal-to-noise ratio. Finally, in a series of 2D simulations it is shown that lower spatial number density in arrays of micro-features, and smaller base size leads to higher overall sensitivity of the micro-patterned piezoresistive sensor.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An intelligent automated footwear system, the system comprising:

a shoe having embedded therein a plurality of sensors and actuators, the plurality of sensor and actuators comprising:

a plurality of pressure sensors, each respective pressure sensor of the plurality of pressure sensors configured to measure a respective contact pressure in a designated region of the shoe;

a first environmental sensor configured to measure an internal environmental parameter of the shoe;

a location or orientation sensor configured to measure a geospatial, positional, kinematic, dynamic, or orientation-related parameter of the shoe; and a thermal actuator system configured to control an internal environmental parameter of the shoe;

a thermal management system connected to the thermal actuator system;

an alert system configured to provide a feedback, alert, or communication signal through the shoe;

a processor;

an in-built power supply configured to supply power as needed to operate the plurality of pressure sensors, the first environmental sensor, the location or orientation sensor, the thermal actuator system, the thermal management system, the alert system, and the processor;

an energy harvester configured to recharge the in-built power supply by harvesting energy from locomotion of a user of the shoe; and a machine-readable medium in operable communication with the processor and having instructions stored thereon that, when executed by the processor, perform the following steps:

receiving, by the processor, a setpoint for the internal environmental parameter of the shoe;

receiving, by the processor, a measurement of the internal environmental parameter of the shoe; and sending, by the processor, a control signal to the thermal actuator system, to drive the measurement of the internal environmental parameter of the shoe to within a tolerance of the setpoint for the internal environmental parameter of the shoe, the plurality of pressure sensors comprising a first pressure sensor disposed and configured to measure contact pressure in a region of the shoe where a heel of a foot of the user would be during use, a second pressure sensor disposed and configured to measure contact pressure in a region of the shoe where a ball of the foot of the user would be during use, and third through seventh pressure sensors disposed and configured to measure contact pressure in regions of the shoe where five toes, respectively, of the foot of the user would be during use.

2. The system according to claim 1, further comprising an external smart device operable by the user of the shoe to input the setpoint for the internal environmental parameter of the shoe, for transmission to the processor.

3. The system according to claim 2, the instructions, when executed by the processor, further performing the following step:

transmitting, by the processor, to the external smart device, the measurement of the internal environmental parameter of the shoe, for display to the user of the shoe on the external smart device.

4. The system according to claim 1, each respective pressure sensor of the plurality of pressure sensors being a piezoresistive pressure sensor.

5. The system according to claim 1, the first environmental sensor comprising a temperature sensor, and the system further comprising a humidity sensor and a moisture sensor.

6. The system according to claim 1, the location or orientation sensor comprising an acceleration sensor, a gyro, an inertial measurement unit (IMU), or a global positioning system (GPS) sensor.

7. The system according to claim 1, the thermal actuator system comprising a Peltier effect device, a Seebeck effect device, or a Joule/Thomson effect device.

8. The system according to claim 1, the thermal management system comprising a rigid water reservoir, a compressible water reservoir, a flexible channeling, a check valve, and a heat sink.

9. The system according to claim 1, the alert system being further configured to alert the user of the shoe by creating a vibration signal.

10. The system according to claim 1, the in-built power supply comprising a rechargeable battery, a supercapacitor, a charging circuit, or a capacitor.

11. The system according to claim 1, the energy harvester comprising a piezoelectric or triboelectric device.

12. The system according to claim 1, each respective pressure sensor of the plurality of pressure sensors comprising a micropyramid surface deformed against a counter electrode, configured to measure the respective contact pressure.

13. The system according to claim 12, each respective micropyramid surface on each respective pressure sensor of the plurality of pressure sensors being patterned with a number density of 3 per millimeter ($mm^{-1}$), a feature size of 100 micrometers (μm), and a pyramidal angle (α) within a range of $50° < \alpha < 60°$.

14. The system according to claim 13, each respective pressure sensor of the plurality of pressure sensors comprising an elastomer layer having a conductivity equal to or greater than 10 Siemens per meter (S/m).

15. The system according to claim 1, the shoe comprising an insole and an outsole that together encapsulate each respective pressure sensor of the plurality of pressure sensors, the first environmental sensor, the location or orientation sensor, the alert system, the processor, the in-built power supply, the energy harvester, and at least a portion of the thermal management system.

16. A method for controlling an intelligent automated footwear system, the method comprising:

measuring, using a plurality of pressure sensors disposed within the intelligent automated footwear system, respective contact pressures in respective designated regions of a shoe;

generating power from an energy harvester embedded within the shoe, the power being generated by locomotion of a user of the shoe;

storing the power in an in-built power supply embedded within the shoe;

powering a processor embedded within the shoe with the power, drawn from the in-built power supply embedded within the shoe;

receiving, by the processor embedded within the shoe, a setpoint for an internal environmental parameter of the shoe, the setpoint received from an external smart device outside the shoe via a wireless connection; and receiving, by the processor embedded within the shoe, a measurement of the internal environmental parameter of the shoe, the measurement received from a first environmental sensor embedded within the shoe, the plurality of pressure sensors comprising a first pressure sensor disposed and configured to measure contact pressure in a region of the shoe where a heel of a foot of the user would be during use, a second pressure sensor disposed and configured to measure contact pressure in a region of the shoe where a ball of the foot of the user would be during use, and third through seventh pressure sensors disposed and configured to measure contact pressure in regions of the shoe where five toes, respectively, of the foot of the user would be during use.

17. The method according to claim 16, further comprising:

determining, by the processor embedded within the shoe, if the setpoint for the internal environmental parameter of the shoe and the measurement of the internal environmental parameter of the shoe are equal to within a predetermined tolerance;

initiating, by the processor embedded within the shoe, if the setpoint for the internal environmental parameter of the shoe and the measurement of the internal environmental parameter of the shoe are not equal to within the predetermined tolerance, a heating or cooling cycle operable on a thermal actuator connected to a thermal management system, the thermal management system at least partially embedded within the shoe; and reporting to the external smart device outside the shoe via the wireless connection, by the processor embedded within the shoe, the measurement of the internal environmental parameter of the shoe and an indication of a status of the heating or cooling cycle.

18. The method according to claim 17, further comprising:

if the setpoint for the internal environmental parameter of the shoe and the measurement of the internal environmental parameter of the shoe are not equal to within the predetermined tolerance, initiating, by the processor embedded within the shoe, an alert event operable on an alert system embedded within the shoe, the first environmental sensor comprising a temperature sensor, and the intelligent automated footwear system further comprising a humidity sensor and a moisture sensor.

19. An intelligent automated footwear system, the system comprising:

a shoe having embedded therein a plurality of sensors and actuators comprising:

a plurality of piezoresistive pressure sensors, each respective pressure sensor of the plurality of pressure sensors configured to measure a respective contact pressure in a designated region of the shoe, at least one piezoresistive sensor of the plurality of piezoresistive sensors being a capacitive/supercapacitive pressure sensor configured to acquire, from a foot of a user of the shoe, a pulsewave form of a heartbeat of the user of the shoe;

an environmental sensor comprising a temperature sensor, a humidity sensor, or a moisture sensor, configured to measure an internal environmental parameter of the shoe;

a location or orientation sensor comprising an acceleration sensor, a gyro, an inertial measurement unit (IMU), or a global positioning system (GPS) sensor, configured to measure a geospatial, positional, kinematic, dynamic, or orientation-related parameter of the shoe; and a thermal actuator system comprising a Peltier effect device, a Seebeck effect device, or a Joule/Thomson effect device, configured to control an internal environmental parameter of the shoe;

a thermal management system connected to the thermal actuator system, the thermal management system comprising a rigid water reservoir, a compressible water reservoir, a flexible channeling, a check valve, and a heat sink;

an alert system configured to provide a feedback, alert, or communication signal through the shoe by creating a vibration signal;

a processor;

an in-built power supply comprising a rechargeable battery, a supercapacitor, a charging circuit, or a capacitor, configured to supply power as needed to operate the pressure sensors, the environmental sensor, the location or orientation sensor, the thermal actuator system, the thermal management system, the alert system, and the processor;

an energy harvester comprising a piezoelectric or triboelectric device, configured to recharge the in-built power supply by harvesting energy from locomotion of the user of the shoe;

an external smart device operable by the user of the shoe to input the setpoint for the internal environmental parameter of the shoe, for transmission to the processor;

an insole and an outsole that together encapsulate each respective pressure sensor of the plurality of pressure sensors, the environmental sensor, the location or orientation sensor, the alert system, the processor, the in-built power supply, the energy harvester, and at least a portion of the thermal management system; and a machine-readable medium in operable communication with the processor and having instructions stored thereon that, when executed by the processor, perform the following steps:

receiving, by the processor, a setpoint for the internal environmental parameter of the shoe;

receiving, by the processor, a measurement of the internal environmental parameter of the shoe;

sending, by the processor, a control signal to the thermal actuator system, to drive the measurement of the internal environmental parameter of the shoe to within a tolerance of the setpoint for the internal environmental parameter of the shoe; and transmitting, by the processor, to the external smart device, the measurement of the internal environmental parameter of the shoe, for display to the user of the shoe on the external smart device.

20. The system according to claim 19, each respective pressure sensor of the plurality of pressure sensors comprising a micropyramid surface deformed against a counter electrode, configured to measure the respective contact pressure, each respective micropyramid surface on each respective pressure sensor of the plurality of pressure sensors patterned with number density of 3 per millimeter ($mm^{-1}$), a feature size of 100 micrometers (μm), and a pyramidal angle (α) in a range of $50° < \alpha < 60°$, and each respective pressure sensor of the plurality of pressure sensors comprising an elastomer layer having a conductivity equal to or greater than 10 Siemens per meter (S/m).

* * * * *